US012788101B2

(12) United States Patent
Berrian et al.

(10) Patent No.: US 12,788,101 B2
(45) Date of Patent: Nov. 10, 2026

(54) ARTICLE OF FOOTWEAR WITH MULTIPLE LAYERS AND METHOD OF MANUFACTURING THE SAME

(71) Applicant: NIKE, Inc., Beaverton, OR (US)

(72) Inventors: Travis J. Berrian, Portland, OR (US); Margaret P. St. Clair, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/205,838

(22) Filed: May 12, 2025

(65) Prior Publication Data

US 2025/0351915 A1 Nov. 20, 2025

Related U.S. Application Data

(60) Provisional application No. 63/647,757, filed on May 15, 2024.

(51) Int. Cl.
*A43B 1/04* (2022.01)
*A43B 1/14* (2006.01)
(Continued)

(52) U.S. Cl.
CPC ..... *A43B 1/04* (2013.01); *A43B 1/14* (2013.01); *A43B 13/38* (2013.01);
(Continued)

(58) Field of Classification Search
CPC ..... A43B 1/04; A43B 1/02; A43B 23/0205; A43B 23/0235
(Continued)

(56) References Cited

U.S. PATENT DOCUMENTS 601,192 A 3/1898 Woodside
782,480 A 2/1905 Albin
(Continued)

FOREIGN PATENT DOCUMENTS

CA 989720 A 5/1976
CN 2358717 Y 1/2000
(Continued)

OTHER PUBLICATIONS

International Search Report and Written Opinion received for PCT Patent Application No. PCT/US2025/029050, mailed on Oct. 2, 2025, 19 pages.
(Continued)

*Primary Examiner* — Marie D Bays
(74) *Attorney, Agent, or Firm* — Shook, Hardy & Bacon L.L.P.

(57) ABSTRACT

Uppers, articles of footwear, and methods of manufacturing uppers and articles of footwear. In aspects, an upper includes a first knit layer and a second knit layer joined by a thermoplastic polymer layer. The first knit layer may include a yarn with a thermoplastic polymer material that is melted and forms the thermoplastic polymer layer that at least partially encapsulates the yarn of the second knit layer and remaining yarn component(s) of the first knit layer. The first knit layer may have a different knit density than the second knit layer. The first knit layer and the second knit layer may both form sock-like constructions and be formed from opposite ends of a tubular knit structure. Knitted components with single or multi-layer knit structures that are manipulated to form an upper are also disclosed.

43 Claims, 21 Drawing Sheets

(51) Int. Cl.

| | |
|---|---|
| ***A43B 13/38*** | (2006.01) |
| ***A43B 23/02*** | (2006.01) |
| ***A43B 23/26*** | (2006.01) |
| ***A43D 3/02*** | (2006.01) |

(52) U.S. Cl.
CPC ..... *A43B 23/0235* (2013.01); *A43B 23/0255* (2013.01); *A43B 23/26* (2013.01); *A43D 3/02* (2013.01)

(58) Field of Classification Search
USPC ..... 36/45
See application file for complete search history.

(56) References Cited

U.S. PATENT DOCUMENTS 1,215,198 A 2/1917 Joseph
1,597,934 A 8/1926 Stimpson
1,601,020 A 9/1926 Holden et al.
1,799,016 A 3/1931 Robert
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,069,819 A 2/1937 Diem
2,147,197 A 2/1939 Glidden
2,314,098 A 3/1943 Mcdonald
2,330,199 A 9/1943 Olive
2,343,390 A 3/1944 Ushakoff
2,400,692 A 5/1946 Herbert
2,422,410 A 6/1947 Gross
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,770,055 A 11/1956 Hayden
2,994,322 A 8/1961 Cullen et al.
3,583,081 A 6/1971 Hideo
3,694,940 A 10/1972 Stohr
3,704,474 A 12/1972 Winkler
3,766,566 A 10/1973 Tadokoro
3,778,856 A 12/1973 Chriestie et al.
3,949,570 A 4/1976 Niederer
3,952,427 A 4/1976 Von et al.
3,972,086 A 8/1976 Belli et al.
4,005,494 A 2/1977 Burn
4,027,402 A 6/1977 Liu et al.
4,031,586 A 6/1977 Von et al.
4,036,037 A 7/1977 Huckfeldt
4,038,699 A 8/1977 Burn
4,211,806 A 7/1980 Civardi et al.
4,232,458 A 11/1980 Bartels
4,237,706 A 12/1980 Patthey
4,255,949 A 3/1981 Thorneburg
4,258,480 A 3/1981 Famolare, Jr.
4,317,292 A 3/1982 Melton
4,341,096 A 7/1982 Safrit et al.
4,373,361 A 2/1983 Thorneburg
4,438,574 A 3/1984 Johnson
4,447,967 A 5/1984 Zaino
4,465,448 A 8/1984 Aldridge
4,607,439 A 8/1986 Kunihiko
4,736,531 A 4/1988 Richard
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,149,583 A 9/1992 Saarikettu
5,152,025 A 10/1992 Hirmas
5,192,601 A 3/1993 Neisler
5,269,862 A 12/1993 Nakajima et al.
5,299,435 A 4/1994 Whalley
5,319,807 A 6/1994 Brier
5,345,638 A 9/1994 Nishida
5,353,524 A 10/1994 Brier
5,371,957 A 12/1994 Gaudio
5,416,961 A 5/1995 Vinay
5,421,034 A 6/1995 Keune
5,461,884 A 10/1995 Mccartney et al.
5,473,781 A 12/1995 Greenberg
5,499,459 A 3/1996 Tomaro
5,511,323 A 4/1996 Dahlgren
5,512,354 A 4/1996 Scholz et al.
5,572,860 A 11/1996 Mitsumoto et al.
5,575,090 A 11/1996 Condini
5,604,997 A 2/1997 Dieter
5,608,976 A 3/1997 Marega et al.
5,618,624 A 4/1997 Dinger et al.
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,765,400 A 6/1998 Roell
5,778,473 A 7/1998 Chen
5,884,419 A 3/1999 Davidowitz et al.
5,970,629 A 10/1999 Tucker et al.
5,996,189 A 12/1999 Wang
6,021,651 A 2/2000 Shima
6,029,376 A 2/2000 Cass
6,032,387 A 3/2000 Johnson
6,052,921 A 4/2000 Oreck
6,082,148 A 7/2000 Wakai et al.
6,088,936 A 7/2000 Bahl
6,151,802 A 11/2000 Reynolds
6,151,922 A 11/2000 Shimasaki
6,170,175 B1 1/2001 Funk
6,308,438 B1 10/2001 Throneburg et al.
6,333,105 B1 12/2001 Tanaka et al.
6,401,364 B1 6/2002 Burt
6,558,784 B1 5/2003 Norton et al.
6,588,237 B2 7/2003 Cole et al.
6,754,983 B2 6/2004 Hatfield et al.
6,922,917 B2 8/2005 Kerns et al.
6,931,762 B1 8/2005 Dua
6,939,372 B2 9/2005 Dong
6,984,596 B2 1/2006 Dickerson
D517,297 S 3/2006 Jones et al.
7,051,460 B2 5/2006 Orei et al.
7,056,402 B2 6/2006 Koerwien et al.
7,201,024 B2 4/2007 Hirayama et al.
7,370,438 B2 5/2008 Vattes et al.
7,386,947 B2 6/2008 Martin et al.
7,441,348 B1 10/2008 Dawson
7,475,500 B2 1/2009 Covatch
7,549,303 B2 6/2009 Callaway et al.
7,578,076 B2 8/2009 Pawlus et al.
7,682,219 B2 3/2010 Falla
7,774,956 B2 8/2010 Dua et al.
8,132,340 B2 3/2012 Meschter
8,448,474 B1 5/2013 Tatler et al.
8,490,299 B2 7/2013 Dua et al.
8,505,220 B2 8/2013 James et al.
8,595,878 B2 12/2013 Huffa et al.
9,072,335 B1 7/2015 Podhajny
9,095,186 B2 8/2015 Follet
9,145,629 B2 9/2015 Podhajny
9,301,567 B2 4/2016 Dealey et al.
9,365,960 B2 6/2016 Craig
9,661,892 B2 5/2017 Meir
9,675,134 B2 6/2017 Kosui et al.
9,803,299 B2 10/2017 Podhajny
9,848,672 B2 12/2017 Podhajny
9,861,160 B2 1/2018 Podhajny et al.
9,970,134 B2 5/2018 Baines et al.
10,022,257 B2 7/2018 Higgins
10,327,498 B2 6/2019 Burch

(56) References Cited

U.S. PATENT DOCUMENTS

| | | | | |
|---|---|---|---|---|
| 10,568,382 | B2 | 2/2020 | Hatfield et al. | |
| 10,718,074 | B2 | 7/2020 | Hipp et al. | |
| 10,750,794 | B2 | 8/2020 | Van et al. | |
| 10,865,504 | B2 | 12/2020 | Dua et al. | |
| 11,198,959 | B2 | 12/2021 | Filipescu et al. | |
| 2002/0078599 | A1 | 6/2002 | Delgorgue et al. | |
| 2002/0148258 | A1 | 10/2002 | Cole et al. | |
| 2002/0184927 | A1 | 12/2002 | Polegato Moretti | |
| 2002/0194749 | A1 | 12/2002 | Jones et al. | |
| 2003/0033838 | A1 | 2/2003 | Ikenaga et al. | |
| 2003/0093919 | A1 | 5/2003 | Wang | |
| 2003/0106346 | A1 | 6/2003 | Matsumoto | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2004/0244221 | A1 | 12/2004 | Hall et al. | |
| 2005/0016023 | A1 | 1/2005 | Burris et al. | |
| 2005/0081402 | A1 | 4/2005 | Orei et al. | |
| 2005/0115284 | A1 | 6/2005 | Dua | |
| 2005/0155137 | A1 | 7/2005 | Berger | |
| 2005/0178027 | A1 | 8/2005 | Hernandez et al. | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0130359 | A1 | 6/2006 | Dua et al. | |
| 2006/0144096 | A1 | 7/2006 | Okuno et al. | |
| 2006/0162187 | A1 | 7/2006 | Byrnes et al. | |
| 2007/0022627 | A1 | 2/2007 | Sokolowski et al. | |
| 2007/0062067 | A1 | 3/2007 | Covatch | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110049 | A1 | 5/2008 | Sokolowski et al. | |
| 2008/0134543 | A1 | 6/2008 | Klein | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2009/0100713 | A1 | 4/2009 | Adami et al. | |
| 2010/0051132 | A1 | 3/2010 | Glenn | |
| 2010/0170651 | A1 | 7/2010 | Scherb et al. | |
| 2010/0186255 | A1 | 7/2010 | Avar et al. | |
| 2010/0287790 | A1 | 11/2010 | Sokolowski et al. | |
| 2011/0023325 | A1 | 2/2011 | Wines et al. | |
| 2011/0030244 | A1 | 2/2011 | Motawi et al. | |
| 2011/0041359 | A1 | 2/2011 | Dojan et al. | |
| 2011/0078921 | A1 | 4/2011 | Greene et al. | |
| 2012/0233882 | A1 | 9/2012 | Huffa et al. | |
| 2012/0233884 | A1 | 9/2012 | Greene | |
| 2012/0255201 | A1 | 10/2012 | Little | |
| 2012/0285043 | A1 | 11/2012 | Dua et al. | |
| 2012/0297643 | A1 | 11/2012 | Shaffer et al. | |
| 2013/0104423 | A1 | 5/2013 | Hatfield et al. | |
| 2013/0219636 | A1 | 8/2013 | Dojan et al. | |
| 2013/0239625 | A1 | 9/2013 | Meir et al. | |
| 2013/0291293 | A1 | 11/2013 | Jessiman et al. | |
| 2013/0340283 | A1 | 12/2013 | Bell et al. | |
| 2014/0059886 | A1* | 3/2014 | Lyttle | A43B 1/00 156/283 |
| 2014/0068968 | A1 | 3/2014 | Podhajny et al. | |
| 2014/0137433 | A1* | 5/2014 | Craig | A43B 23/024 66/170 |
| 2014/0137434 | A1* | 5/2014 | Craig | A43B 23/026 66/170 |
| 2014/0150295 | A1 | 6/2014 | Dua et al. | |
| 2014/0237861 | A1 | 8/2014 | Podhajny | |
| 2014/0245545 | A1 | 9/2014 | Meir et al. | |
| 2014/0245633 | A1 | 9/2014 | Podhajny | |
| 2014/0310983 | A1 | 10/2014 | Tamm et al. | |
| 2014/0310984 | A1 | 10/2014 | Tamm et al. | |
| 2014/0352173 | A1 | 12/2014 | Bell et al. | |
| 2015/0013187 | A1 | 1/2015 | Taniguchi et al. | |
| 2015/0075031 | A1 | 3/2015 | Podhajny et al. | |
| 2015/0107307 | A1 | 4/2015 | Kosui et al. | |
| 2015/0128449 | A1 | 5/2015 | Lin et al. | |
| 2015/0216257 | A1 | 8/2015 | Meir et al. | |
| 2015/0313316 | A1 | 11/2015 | Boucher et al. | |
| 2015/0351483 | A1 | 12/2015 | Podhajny | |
| 2015/0359290 | A1 | 12/2015 | Podhajny et al. | |
| 2016/0095377 | A1 | 4/2016 | Tamm | |
| 2016/0213097 | A1 | 7/2016 | Uchikawa et al. | |
| 2017/0027284 | A1 | 2/2017 | Craig | |
| 2017/0181501 | A1 | 6/2017 | Gautier et al. | |
| 2017/0224044 | A1 | 8/2017 | Dua et al. | |
| 2017/0311672 | A1* | 11/2017 | Hipp | A43B 1/04 |
| 2017/0370027 | A1 | 12/2017 | Da et al. | |
| 2018/0020761 | A1 | 1/2018 | Cai et al. | |
| 2018/0042340 | A1 | 2/2018 | Kuo et al. | |
| 2018/0168271 | A1 | 6/2018 | Ly | |
| 2018/0235318 | A1 | 8/2018 | Terai et al. | |
| 2018/0317593 | A1 | 11/2018 | Dealey | |
| 2019/0069637 | A1 | 3/2019 | Lang et al. | |
| 2019/0208862 | A1 | 7/2019 | Poegl et al. | |
| 2019/0335857 | A1 | 11/2019 | Huffa et al. | |
| 2019/0380442 | A1 | 12/2019 | Craig | |
| 2020/0029647 | A1 | 1/2020 | Unnewehr et al. | |
| 2020/0170330 | A1 | 6/2020 | Verfl et al. | |
| 2020/0178650 | A1 | 6/2020 | Craig | |
| 2020/0221826 | A1 | 7/2020 | Dua et al. | |
| 2021/0052039 | A1 | 2/2021 | Johnson et al. | |
| 2021/0378348 | A1 | 12/2021 | Dealey | |
| 2023/0038383 | A1 | 2/2023 | Dua et al. | |
| 2025/0049169 | A1* | 2/2025 | Baranek | A43B 1/04 |
| 2026/0144333 | A1* | 5/2026 | Kanchagar | A43B 23/0235 |

FOREIGN PATENT DOCUMENTS

| | | | |
|---|---|---|---|
| CN | 1625352 | A | 6/2005 |
| CN | 1639403 | A | 7/2005 |
| CN | 101248228 | A | 8/2008 |
| CN | 101583294 | A | 11/2009 |
| CN | 201491780 | U | 6/2010 |
| CN | 103393256 | A | 11/2013 |
| CN | 103517647 | A | 1/2014 |
| CN | 203399745 | U | 1/2014 |
| CN | 103687507 | A | 3/2014 |
| CN | 103841851 | A | 6/2014 |
| CN | 104106882 | A | 10/2014 |
| CN | 104473376 | A | 4/2015 |
| CN | 104486959 | A | 4/2015 |
| CN | 105264133 | A | 1/2016 |
| CN | 204994752 | U | 1/2016 |
| CN | 106037119 | A | 10/2016 |
| DE | 0870963 | C | 3/1953 |
| DE | 1084173 | B | 6/1960 |
| DE | 19738433 | A1 | 4/1998 |
| DE | 19728848 | A1 | 1/1999 |
| EP | 0090580 | A1 | 10/1983 |
| EP | 0279950 | A2 | 8/1988 |
| EP | 0448714 | A1 | 10/1991 |
| EP | 0728860 | A1 | 8/1996 |
| EP | 0758693 | A1 | 2/1997 |
| EP | 0898002 | A2 | 2/1999 |
| EP | 1233091 | A1 | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2649898 | A1 | 10/2013 |
| EP | 2805638 | A1 | 11/2014 |
| FR | 2171172 | A1 | 9/1973 |
| GB | 0538865 | A | 8/1941 |
| GB | 2018837 | A | 10/1979 |
| GB | 1603487 | A | 11/1981 |
| JP | 63-257504 | A | 10/1988 |
| JP | 06-020408 | U | 3/1994 |
| JP | 06-113905 | A | 4/1994 |
| JP | 07-003502 | A | 1/1995 |
| JP | 08-109553 | A | 4/1996 |
| JP | 11-302943 | A | 11/1999 |
| JP | 3148210 | U | 2/2009 |
| JP | 2013-502301 | A | 1/2013 |

(56) References Cited

FOREIGN PATENT DOCUMENTS

| | | | |
|---|---|---|---|
| JP | 2014-508009 | A | 4/2014 |
| NL | 7304678 | A | 10/1974 |
| WO | 90/03744 | A1 | 4/1990 |
| WO | 98/43506 | A1 | 10/1998 |
| WO | 00/32861 | A1 | 6/2000 |
| WO | 01/33987 | A1 | 5/2001 |
| WO | 02/31247 | A1 | 4/2002 |
| WO | 2004/043184 | A1 | 5/2004 |
| WO | 2007/023690 | A1 | 3/2007 |
| WO | 2007/058275 | A1 | 5/2007 |
| WO | 2011/043998 | A2 | 4/2011 |
| WO | 2012/004162 | A1 | 1/2012 |
| WO | 2014/134247 | A1 | 9/2014 |
| WO | 2020/142357 | A1 | 7/2020 |

OTHER PUBLICATIONS

Non-Final Office Action received for U.S. Appl. No. 19/229,471, mailed on Jan. 23, 2026, 17 pages.

Non-Final Office Action received for U.S. Appl. No. 19/229,521, mailed on Jan. 23, 2026, 18 pages.

Declaration of Dr. Edward C. Frederick from the US Patent and Trademark Office Inter Partes Review of U.S. Pat. No. 7,347,011, 178 pages.

Eberle et al., "Clothing Technology", Sixth German Edition and Third English Edition, Exhibit 1013 in IPR2013-00067, Nov. 28, 2012, 3 pages.

Knitting Industry, "Santoni X-MACHINE for 3D Shoe Uppers on Show at ISPO", Available online at: <https://www.knittingindustry.com/santoni-xmachine-for-3d-shoe-uppers-on-show-at-ispo/>, Jan. 28, 2020, 2 pages.

Letter from Bruce Huffa, Dec. 23, 2013, 71 pages.

Notice of Allowance received for U.S. Appl. No. 17/408,168, mailed on Jun. 9, 2025, 8 pages.

Notice of Allowance received for U.S. Appl. No. 17/737,380, mailed on Jun. 11, 2025, 8 pages.

Spencer, D. J., "Knitting Technology: A Comprehensive Handbook and Practical Guide", Third Edition, Woodhead Publishing Limited, 2001, 446 pages.

Woolmark, "Wool Footwear—Knitted Upper", Available online at: <https://www.woolmark.com/industry/use-wool/product-innovations/wool-knitted-upper/>, Retrieved on Sep. 24, 2025, 3 pages.

* cited by examiner

ARTICLE OF FOOTWEAR WITH MULTIPLE LAYERS AND METHOD OF MANUFACTURING THE SAME

CROSS-REFERENCE TO RELATED APPLICATIONS AND PRIORITY CLAIM

This non-provisional patent application claims priority to U.S. provisional application No. 63/647,757, filed on May 15, 2024, and titled "Article of Footwear with Multiple Layers," the entire contents of which is incorporated herein by reference.

BACKGROUND

Footwear typically includes a series of components that are attached together. For example, footwear typically includes an upper secured to one or more sole structures. The sole structures can include an insole or strobel secured to the upper to form a foot-supporting surface; a midsole configured to provide cushioning and attenuate ground forces; and an outsole that provides traction and/or abrasion resistance. The strobel generally has a thickness that allows it to have sufficient structure to connect, and be secured to, an upper and/or a midsole/outsole. The inclusion of a strobel may thus increase the height of an article of footwear and/or may increase the weight of an article footwear, and can result in additional post-processing steps that increase the cost and time required for manufacturing footwear.

BRIEF DESCRIPTION OF THE DRAWINGS

Examples of aspects herein are described in detail below with reference to the attached drawing figures, wherein.

DETAILED DESCRIPTION

Figure 1A:
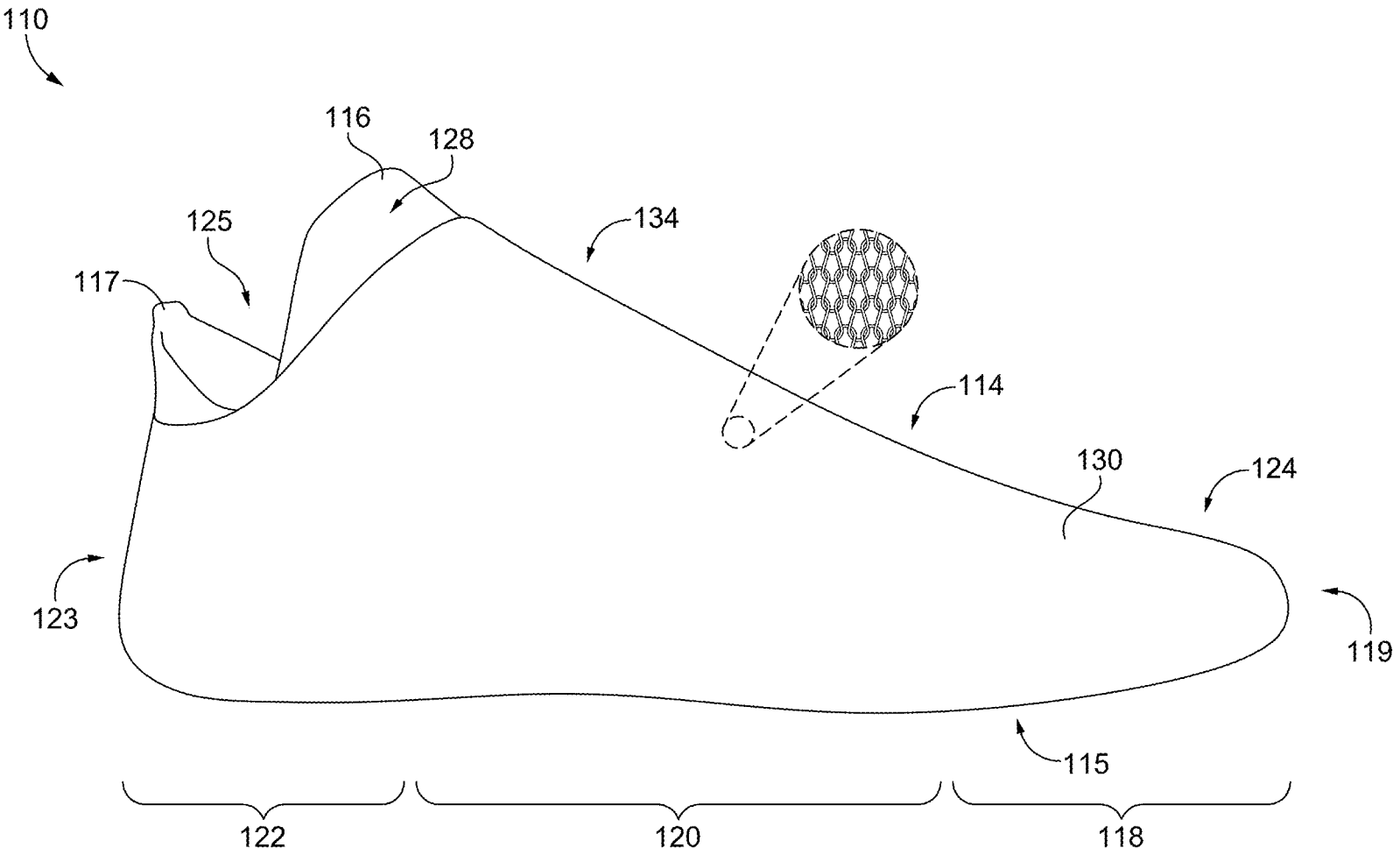
FIGS. 1A and 1B depict a medial view and a lateral view of an upper for an article of footwear, in accordance with aspects herein.

In general, and at a high level, aspects herein are directed to textiles including knitted components, uppers, and articles of footwear, as well as methods of manufacturing the same, among other things.

In aspects, an upper can include a textile, e.g., a knitted component.

In aspects, a knitted component can include a single knit layer or multiple knit layers, e.g., a first knit layer and a second knit layer, that are coextensive. In some aspects, first and second knit layers can extend into and/or through a forefoot region, a midfoot region, and/or a heel region of an upper. In some aspects, first and second knit layers can extend into and/or through an underfoot portion of an upper and/or an overfoot portion of an upper. For example, in some aspects, first and second knit layers may form a sock type and/or bootie type construction. Having this configuration, a knitted component of an upper may substantially wrap around, envelop, and/or enclose a foot-receiving portion, e.g., forming a substantially 360-degree upper. In some aspects, a knitted component forming part of an upper can be secured to a midsole structure with or without a strobel. For example, in some aspects, an underfoot portion of a knitted component can include a surface that can be secured to a midsole, and in addition, a generally 360-degree construction of the knitted component of the upper can help impart strength, containment, and stability, and may help to distribute forces applied to the upper through the midsole.

In aspects, a knitted component forming at least part of an upper of an article of footwear can include one or more yarns. In some aspects, at least some of the yarns may be different, e.g., different in material(s), density, melting point, denier, diameter, construction (e.g., single or multi-component), or the like. In aspects, a knitted component can include a thermoplastic material, e.g., a thermoplastic polymer material, that is formed into a thermoplastic layer, e.g., a thermoplastic polymer layer. For example, a knitted component can include a yarn formed with a low-melting thermoplastic material and may include another yarn formed of a material having a higher melting temperature, or may include a yarn that combines both materials. For example, a knitted component can be formed with a core-sheath yarn having a low-melting thermoplastic material forming a sheath that surrounds a core (e.g., a filament or multi-filament core) formed of a material that melts at a higher temperature than the low-melting thermoplastic material. In knitted components with multiple knit layers, certain materials and/or yarns may be present in one layer and may be substantially excluded from another layer. For example, in knitted components that have first and second knit layers, a thermoplastic material in the first knit layer may not be present in the second knit layer or vice versa. In some aspects, optionally, a knitted component, including a first and/or second knit layer thereof, may include a high-tenacity yarn, e.g., a yarn having a tenacity that is at least 5 grams per denier (g/D).

Knitted components as described herein can be formed on a knitting machine. For example, a single layer or multi-layer knitted component can be formed on a knitting machine in a single knitting process. In one example, once a knitted component, e.g., with a single knit layer or with a first knit layer and a second knit layer, is created, a thermoplastic layer can then be formed by melting low-melting thermoplastic material present in the knitted component, e.g., in the first knit layer, e.g., incorporated via a yarn, which may then re-flow due to gravity and/or applied pressure, and then re-solidify and harden, to at least partially encapsulate remaining knit structures (structures that have not melted), e.g., in the first knit layer and in the second knit layer. In this way, the thermoplastic layer may effectively fuse, join, or interconnect the knit structures, e.g., of the first knit layer and the second knit layer, e.g., providing a substantially rigid structure. Fusing the knitted component, e.g., the first knit layer and the second knit layer thereof, using a thermoplastic material incorporated into the knitted component, can provide a relatively thinner and lighter knitted component. It can also impart greater structure to the upper, e.g., enhancing containment around a wearer's foot and increasing abrasion resistance, helping to reduce or limit the need for additional components (e.g., that might be added in post-knitting processing steps). Reducing or eliminating the introduction of additional components, e.g., in post-processing steps, can help decrease the time for manufacturing, complexity, and weight of articles of footwear, and can the increase recyclability of the upper.

In aspects, once a knitted component, e.g., single layer or multi-layer knitted component, is fused, un-melted knit structures can remain. This may include a core of a fusible yarn, e.g., that remains interlooped in one or more knit layers, e.g., a first knit layer and/or a second knit layer. High-melting yarns can also remain. In some aspects, a core yarn remaining in a first knit layer may have a smaller diameter than a yarn present in a second knit layer. In some aspects, the thermoplastic layer can substantially fully encapsulate yarns in a knitted component. For example, yarns in a knit layer that forms an inner surface of the upper may be substantially fully encapsulated while yarns in an outer knit layer may be only partially encapsulated, or the opposite configuration may be provided. In one example, if a first knit layer forms an inner layer, a thermoplastic material may fully encapsulate a remaining core yarn in the first knit layer and partially encapsulate one or more second yarns in the second knit layer. Thus, as a result, the second knit layer may retain a non-smooth texture from the knitted second set of yarns, while the thermoplastic material may extend over the inner surface of the first knit layer to form a smooth inner surface. In aspects, an upper with a smooth inner surface may provide increased comfort for a wearer, while a non-smooth outer surface may increase abrasion resistance.

In aspects, a knitted component may include different knit densities. For example, in some aspects, a first knit layer and a second knit layer may include different knit densities. For example, the first knit layer may have a lower knit density than the second knit layer. The lower knit density of the first knit layer can help reduce the weight and increase the breathability of the upper, while the higher knit density of the second knit layer, e.g., that may incorporate a high-tenacity yarn, can help provide structure and support for the upper. In some aspects, a first knit layer may have a greater knit density than a second knit layer. In some aspects, a first knit layer includes a first set of yarns that include a thermoplastic material, and thus, a greater knit density in the first knit layer may increase the concentration of the thermoplastic material. The higher concentration of thermoplastic material may help provide a thicker and/or more consistent thermoplastic layer, which can help enhance durability and moisture resistance. Knit density can be measured by number of stitches per centimeter, e.g., horizontally, vertically, or both horizontally and vertically.

In some aspects, a knitted component, e.g., single layer or multi-layer knitted component, can form a tubular knitted structure. For example, a first knit layer can form one portion of a tube at a first end, and a second knit layer can form a different portion of the tube at a second end. The tubular knitted structure may be arranged on a last so that one portion (e.g., corresponding to the first knit layer) is positioned directly around the last, and then the tubular knitted structure may be folded in half so that the second portion (e.g., corresponding to the second knit layer) is folded over and around the first knit layer on the last. This can be used to create a dual-layer upper. In addition, heat and/or energy can be applied, e.g., to melt materials in the knitted component, to form the thermoplastic layer and to fuse the first and second knit layers together as the knitted component is on the last. In other aspects, a single layer knitted component may be formed, placed on a last, and then heated so that thermoplastic materials in the single layer knitted component melt to form a thermoplastic layer that extends through at least part of the knitted component.

In some aspects, manipulating first and second layers of a knitted component formed as a tubular structure allows a knitted component to extend around a wearer's foot while remaining mostly or substantially seamless. For example, in some aspects, there can be a small seam at a toe end, that may extend partially through the forefoot region or may extend around the toe end of the upper. However, in some aspects, the knitted component may be seamless through the midfoot and heel regions, including regions in an underfoot portion. Reducing seams can increase wearer comfort and simplify post-processing and/or downstream processing in a footwear manufacturing process.

In some aspects, a collar of an upper can be a location where first and second knit layers of a knitted component are joined or connected together by a common knit structure. That is, a collar can represent a fold line where a tubular knit structure is folded. In aspects, within the collar area, first and second knit layers can have different yarns and/or knit constructions compared to the rest of the first and second knit layers. For example, a thermoplastic material may be absent from first and second knit layers in a collar area such that the thermoplastic layer that joins or bonds the first and second knit layers is absent in the collar area. Rather, the collar area may include a yarn or knit structure with elastic properties, e.g., allowing it to stretch and enable easier entry of a foot into the upper. In aspects, yarns forming the collar may be more elastic than yarns forming one or more other portions of the knitted component and/or upper.

In some non-limiting aspects, an upper may include a textile, e.g., a single layer knitted component, that includes thermoplastic material(s) incorporated therein that are fused, e.g., at least partially melted, flowed, and re-solidified, to create a thermoplastic layer, among other elements.

In some non-limiting aspects, an upper may include a textile, e.g., a multi-layer knitted component, e.g., a dual-layer knitted component, that includes thermoplastic material(s) incorporated therein that are fused, e.g., at least partially melted, flowed, and re-solidified, to create a thermoplastic layer, among other elements.

The articles of footwear described herein may include a running shoe, a baseball shoe, a basketball shoe, a skateboarding shoe, a cycling shoe, an American football shoe, a tennis shoe, a global football shoe, a training shoe, a walking shoe, a hiking shoe, or another sport or activity shoe, or the like. The concepts described herein may also be applied to other footwear types that are considered non-athletic, e.g., dress shoes, loafers, sandals, and work boots. Herein, an article of footwear may be divided into different general regions; a forefoot region generally includes portions of the article of footwear that correspond to the toes and joints connecting the metatarsals with the phalanges; the forefoot region terminates in a toe end of the article of footwear; a midfoot region generally includes portions of the article of footwear corresponding with an arch area and an instep area of the foot; a heel region generally corresponds with rear portions of the foot including the calcaneus bone; the heel region terminates in a heel end of the article of footwear. The articles of footwear described herein may include a lateral side which corresponds with an outside area of the foot (the surface that faces away from the other foot) and a medial side which corresponds with an inside area of the foot (the surface that faces toward the other foot). The different regions and sides described herein are intended to represent general areas of footwear to aid in the following discussion and are not intended to demarcate precise areas. The different regions and sides may be applied to the article of footwear as a whole, to the upper, and to sole structures.

The term "outer-facing surface," as used herein, refers to a surface of an upper or article of footwear that faces an external environment. In some aspects, the outer-facing surface can be the outermost-facing surface or exterior surface of an upper or article of footwear. The term "inner-facing surface," as used herein, refers to a surface of an upper or article of footwear that faces a void for receiving the wearer's foot. In some aspects, the inner-facing surface can be the innermost-facing surface or interior surface of an upper or article of footwear. The terms "external" and "internal" as used herein are relative terms such that a layer that is external is positioned external to one or more internal layers, and a layer that is internal is positioned internal to one or more external layers.

The term "knit," as used herein, refers to a textile piece that is formed from at least one yarn that is manipulated (e.g., with a knitting machine) to form a plurality of intermeshed loops (also known as interlooping) that define courses and wales. The term "course", as used herein, refers to a predominantly horizontal row of knit loops in an upright textile as it is knit on the knitting machine that is produced by adjacent needles during the same knitting cycle. The course may comprise one or more stitch types, such as a knit stitch, a missed stitch, a tuck stitch, a held stitch, a transfer stitch, a rib stitch, and the like, as these terms are known in the art of knitting. The term "course-wise direction" refers to a direction that is generally parallel to the knit courses of the textile piece. The term "wale", as used herein, is a predominantly vertical column of intermeshed or interlooped knit loops, generally produced by the same needle at successive (but not necessarily all) courses or knitting cycles. The term "wale-wise direction" refers to a direction that is generally parallel to the knit wales of a textile piece.

The term "single knit construction," as used herein, refers to a single-layer knit construction generally formed on a single needle bed (e.g., a single-bed construction). In some examples, a single knit construction can be formed on a multi-bed knitting machine by knitting a number of knit courses on a first needle bed of the knitting machine and then transferring loops to a second needle bed of the knitting machine where a number of knit courses are then knit. This knitting sequence may be repeated any number of times as further described below. Common single knit constructions include single jersey.

The term "double knit construction," as used herein, refers to a knit construction that is generally formed on at least two needle beds of a knitting machine (e.g., a multi-bed construction). Multi-bed knit constructions include two opposing faces or layers of knit loops and/or tucks, e.g., one face/layer of loops formed on a first needle bed (e.g., a first knit layer), and a second face/layer of loops formed on a second needle bed (e.g., a second knit layer). In example aspects, faces/layers may be joined by yarns that interloop with yarns in both the first face/layer and the second face/layer of a double knit construction (e.g., transfer yarns). However, aspects herein contemplate that the two faces/layers may not be joined such that a space or potential space can be formed between two faces/layers. Common double knit constructions include double jersey, rib, interlock, cardigan, other "double bed" knit structures initially formed on at least two needle beds, and other knit structures having two opposing faces/layers of knit loops or tucks, including full-gauge and less-than full gauge variations of those structures.

The term "knitted mesh structure," as used herein, refers to a knit structure having a plurality of openings intentionally created using a combination of tuck stitches (or similar types of stitches such as held stitches) and knit stitches that may be knitted on every other needle, every third needle, and the like, of a needle bed of a knitting machine. Thus, a knit stitch of a knit course may be spaced apart from an adjacent knit stitch by one wale, two wales, three wales, and the like to create the intentional or engineered openings in the knit structure. These engineered openings help to create a mesh structure. This can be contrasted with the inherent openings of a knit loop or between adjacent knit loops where the inherent openings are generally not spaced apart by a wale, two wales, and the like. Knitted mesh structures have a more open structure and lower knit stitch density. Accordingly, in example aspects herein, e.g., where a knit layer has a knitted mesh structure, the knit layer has a lower knit stitch density (e.g., number of knit stitches per centimeter) than another portion, area, or knit layer not having a knitted mesh structure. In aspects, in a multi-layer knit structure, one knit layer, e.g., a first knit layer, may have a knitted mesh structure, and another knit layer, e.g., a second knit layer, may not have a knitted mesh structure, or vice versa.

The term "integrally knit," as used herein, refers to a knit textile having a yarn from one or more knit courses in a first knit layer, zone, region, or area interlooped with one or more knit courses of another knit layer, zone, region, or area. The interlooping may be through a simple knit stitch, a tuck stitch, a held stitch, a float or miss stitch, and the like. In this way, zones that are integrally knit together have a seamless transition such that they seamlessly extend from one another, e.g., via co-extensive yarns.

Forming some or all portions of an upper using a knit construction may provide advantages including, but not limited to, a particular degree of elasticity (for example, as expressed in terms of Young's modulus), breathability, bendability, strength, moisture absorption, weight, abrasion resistance, and/or any combination thereof. These characteristics may be accomplished by selecting a particular knit structure, by varying the size and tension of the knit structure, by using one or more yarns formed of a particular material (e.g., a polyester material, a relatively inelastic material, or a relatively elastic material such as elasticated yarns, a thermoplastic material, and the like), by selecting yarns of a particular size (e.g., denier), and/or a combination thereof. Using a knit construction may also provide desirable aesthetic characteristics by incorporating yarns having different colors, textures or other visual properties arranged in a particular pattern. The yarns themselves and/or the knit structure formed by one or more of the yarns may be varied at different locations such that an upper may have different properties as described herein.

Yarns described herein may include yarns formed from, for example, synthetic materials. In some aspects, yarns used to form a knitted component can include high-melting polymer yarns (e.g., yarns that melt at about 175 degrees Celsius or higher in one example) including polyethylene terephthalate (PET) yarns (commonly known as polyester), recycled PET yarns, polyamide yarns (commonly known as nylon), elastane yarns, and other high-melting synthetic yarns. In addition, yarns described herein may include low-melting polymer yarns (e.g., yarns that melt below 175 degrees Celsius in one example), which may be a thermoplastic material such as thermoplastic polyurethane.

Yarns described herein may include monofilament yarns or multi-filament yarns. Multi-filament yarns can include filaments of the same material or can include filaments of different material. In addition, a monofilament yarn may be a monofilament or may be a bi-component. For example, a monofilament yarn may have a first yarn component formed of a first material and a second yarn component formed of a second material with a lower melting temperature than the first material. The first yarn component may be in the form of a core, and the second yarn component may be in the form of a sheath surrounding the core, where the core and sheath may be extruded together or the sheath may be a coating applied to the core.

In aspects, a sheath of a core-sheath yarn may include a synthetic polymeric material formed from a polymer that melts at relatively low temperatures (e.g., less than about 175 degrees Celsius in one example). In aspects, a sheath may include a thermoplastic material that is capable of melting upon the application of heat at a temperature greater than or equal to the melting temperature of the thermoplastic material. The thermoplastic material then solidifies upon cooling and is capable of re-melting when heat of a temperature greater than or equal to the melting temperature of the thermoplastic material is re-applied. In aspects, a melting point of a thermoplastic material forming a sheath of a first set of yarns (e.g., yarns in a first layer) is greater than a melting point of a material forming at least part of an additional layer (e.g., yarns in a second knit layer). The melting temperature of the thermoplastic material forming the sheath of the first set of yarns and the other materials (e.g., the core in the first set of yarns and yarn(s) in the second set of yarns) may be sufficiently different from the melting temperature of the core of the first set of yarns (when a core-sheath yarn is used) such that core of the first set of yarns and the second set of yarns are not adversely affected (e.g., burning, charring, or singeing) when heat is applied to melt the sheath of the first set of yarns.

The term "thermoplastic layer," as used herein, refers to a solidified thermoplastic material, e.g., thermoplastic polymer material, that at least partially encapsulates a yarn(s) of a knit structure. The thermoplastic layer may be a thermoformed layer formed from knitted yarns, as further described herein. The term "thermoformed layer" refers to a generally unitary structure formed after heat and/or pressure is applied to thermoplastic material of one or more yarn(s) and after the melted thermoplastic material has solidified upon cooling. Thus, a thermoformed layer may include the same polymeric material as the thermoplastic material used to form some of the yarn of the knit structure (e.g., sheath of the first yarn).

Unless indicated otherwise, all measurements provided herein are taken when the upper and/or article of footwear is at standard ambient temperature and pressure (298.15 K and 100 kPa) and is in a resting (non-tensioned) state. As used herein, the term "about" means within ±10% of an indicated value.

Figure 1B:
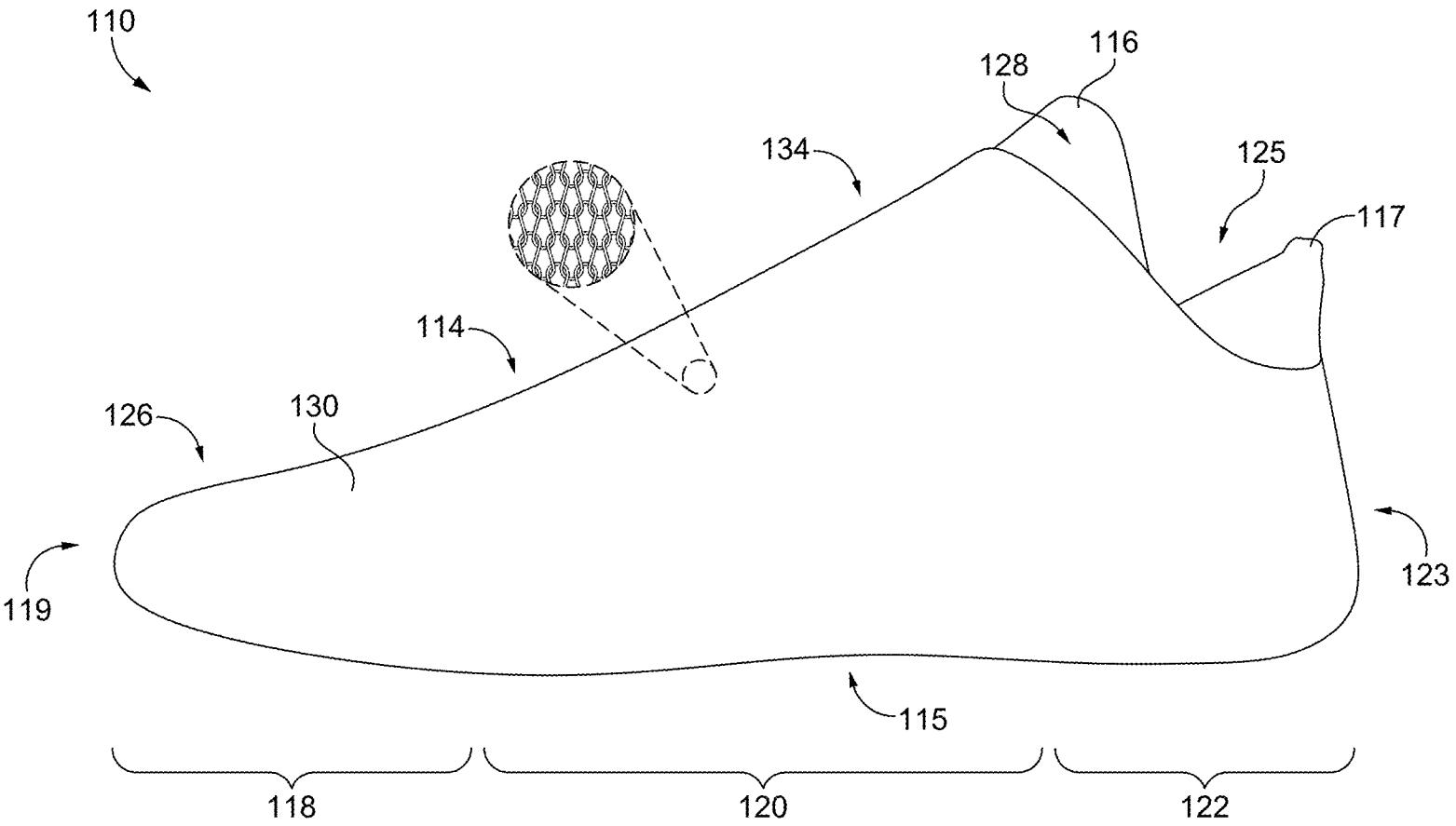
Figure 2:
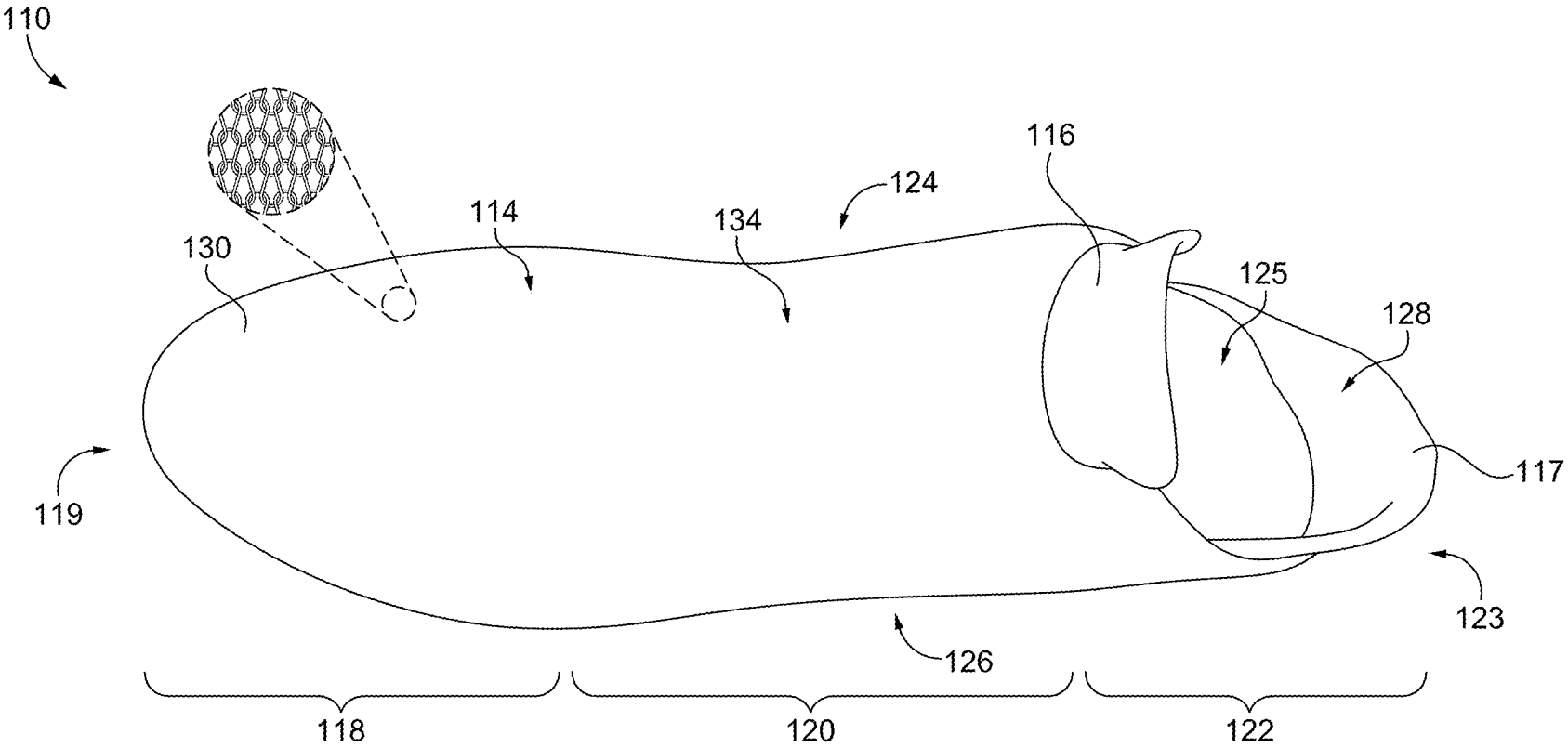
FIG. 2 depicts a top view of the upper of FIGS. 1A and 1B, in accordance with aspects herein.
Figure 3:
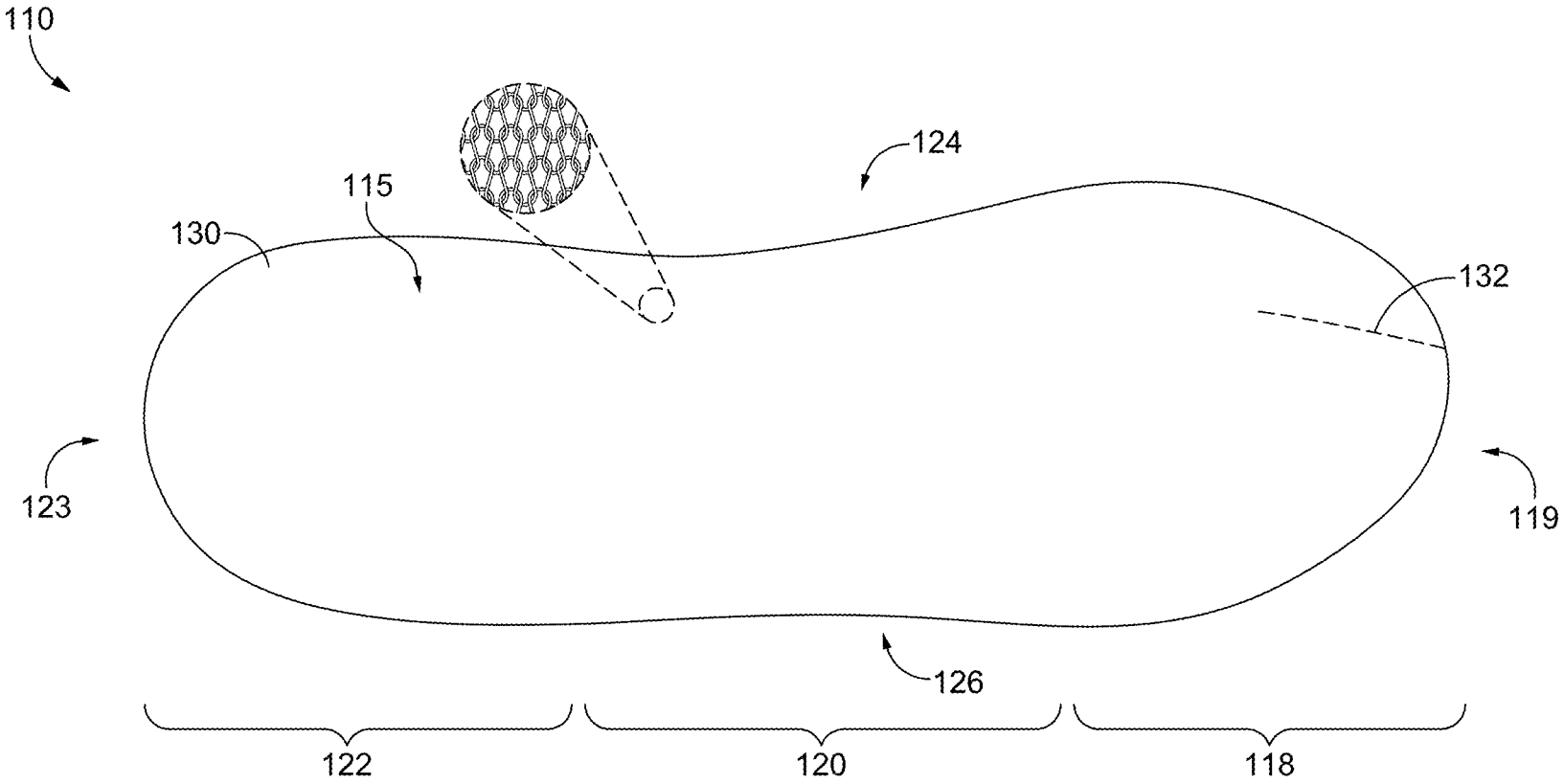
FIG. 3 depicts a bottom view of the upper of FIGS. 1A and 1B, in accordance with aspects herein.
Figure 4B:
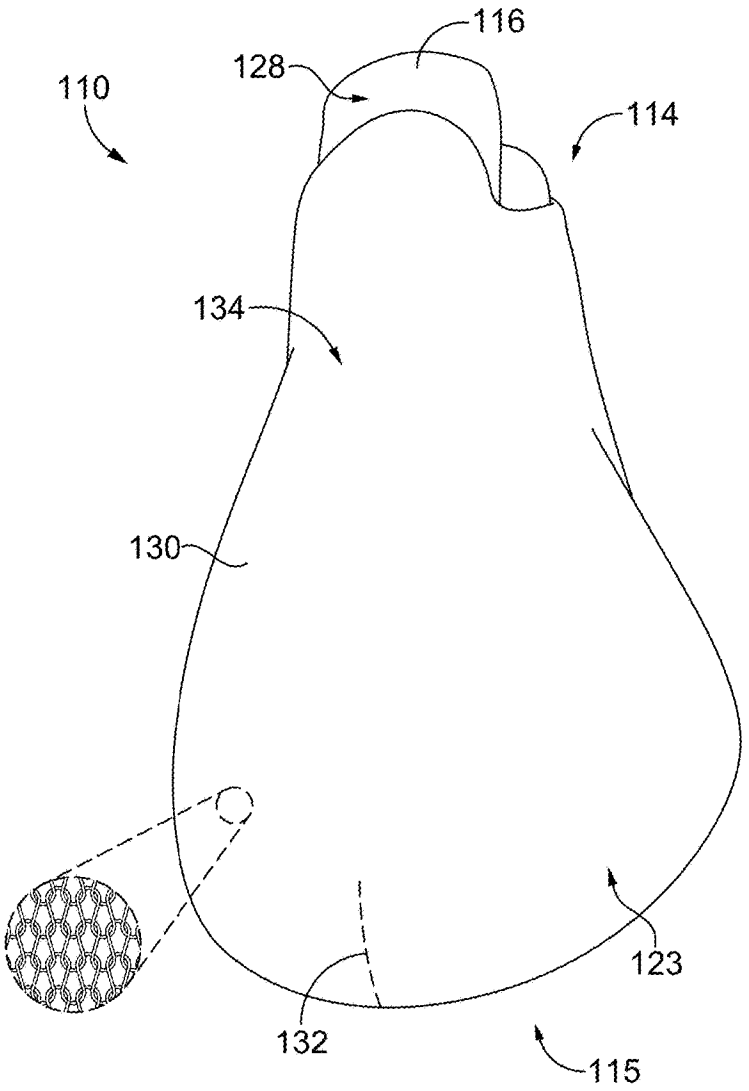
FIGS. 4A and 4B depict a back view and a front view of the upper of FIGS. 1A and 1B, in accordance with aspects herein.
Figure 4A:
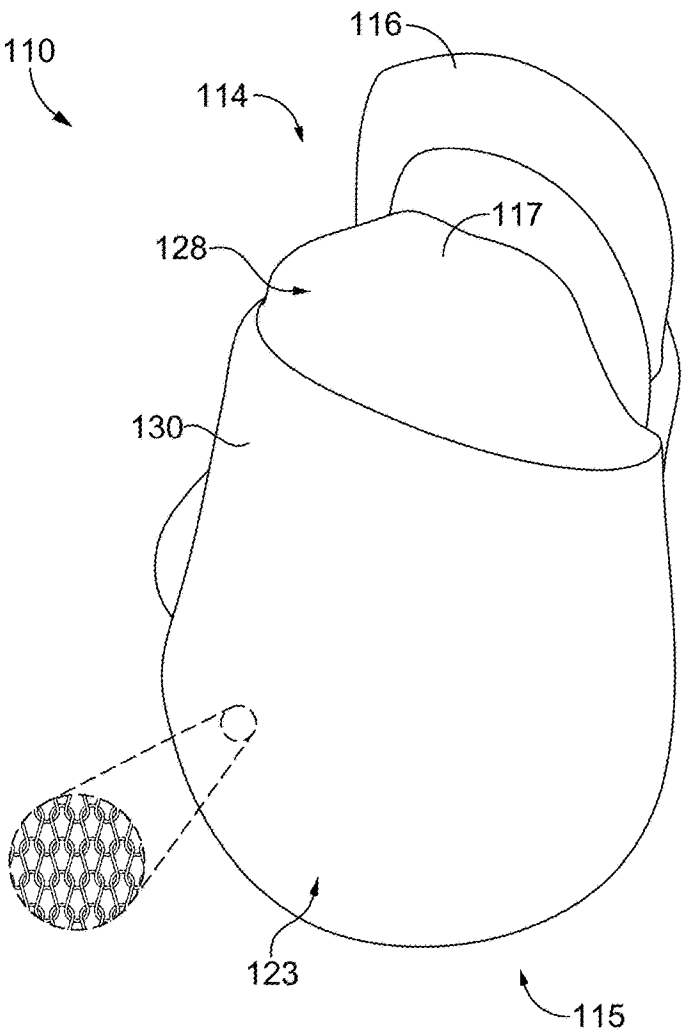

FIGS. 1A and 1B depict a medial view and a lateral view of an upper 110 for an article of footwear (e.g., article of footwear 100 in FIG. 7), in accordance with aspects herein. FIGS. 2 and 3 depict a top view and a bottom view of the upper 110. FIGS. 4A and 4B depict a rear view and a front view of the upper 110. The upper 110 includes a forefoot region 118 having a toe end 119, a midfoot region 120, and a heel region 122 having a heel end 123, a medial side 124, and a lateral side 126. The upper 110 includes a collar 128 defining an ankle opening 125 that opens into a space inside the upper 110 for a wearer's foot.

The upper 110 includes an overfoot portion 114 and an underfoot portion 115. The overfoot portion 114 generally defines the area of the upper 110 extending over the top and sides of a wearer's foot. Thus, the overfoot portion 114 includes a throat region 134 and at least a portion of the forefoot region 118, the midfoot region 120, the heel region 122, the medial side 124, and the lateral side 126. The underfoot portion 115 includes the area configured to extend underneath a wearer's foot. The underfoot portion 115 may also extend continuously through portions of the forefoot region 118, the midfoot region 120, the heel region 122, the medial side 124, and the lateral side 126.

In this example, the throat region 134 extends between the medial side 124 and the lateral side 126, e.g., optionally continuously, e.g., without a distinct tongue being incorporated or attached. The collar 128 may include a tongue tab 116 that extends outward from the ankle opening 125. Similarly, the collar 128 may include a heel tab 117 that represents an outwardly protruding portion of the collar 128 in the heel region 122. The tongue tab 116 and the heel tab 117 may be used individually or in combination to pull the upper 110 over a wearer's foot.

The upper 110 may be partially or entirely formed from a knit textile. In aspects, the upper 110 includes a knitted component 130. The knitted component 130 may form most of the upper 110 and in some examples, may form substantially the entire upper. That is, the knitted component 130 may form the forefoot region 118, the midfoot region 120, and the heel region 122, both on the medial side 124 and on the lateral side 126, and may extend through the overfoot portion 114 and the underfoot portion 115. With this configuration, the knitted component 130 may have a sock-like or bootie-like construction, in that it extends around the substantially all of the wearer's foot. In addition, the knitted component 130 may be a single textile component having a unitary structure such that the knitted component 130 may extend generally seamlessly through the different regions of the upper 110. However, it should be noted that even in examples where the knitted component 130 forms substantially all of the upper 110, the upper 110 may include additional textile or non-textile components layered on top of the knitted component 130 and/or underneath the knitted component 130.

Figure 11:
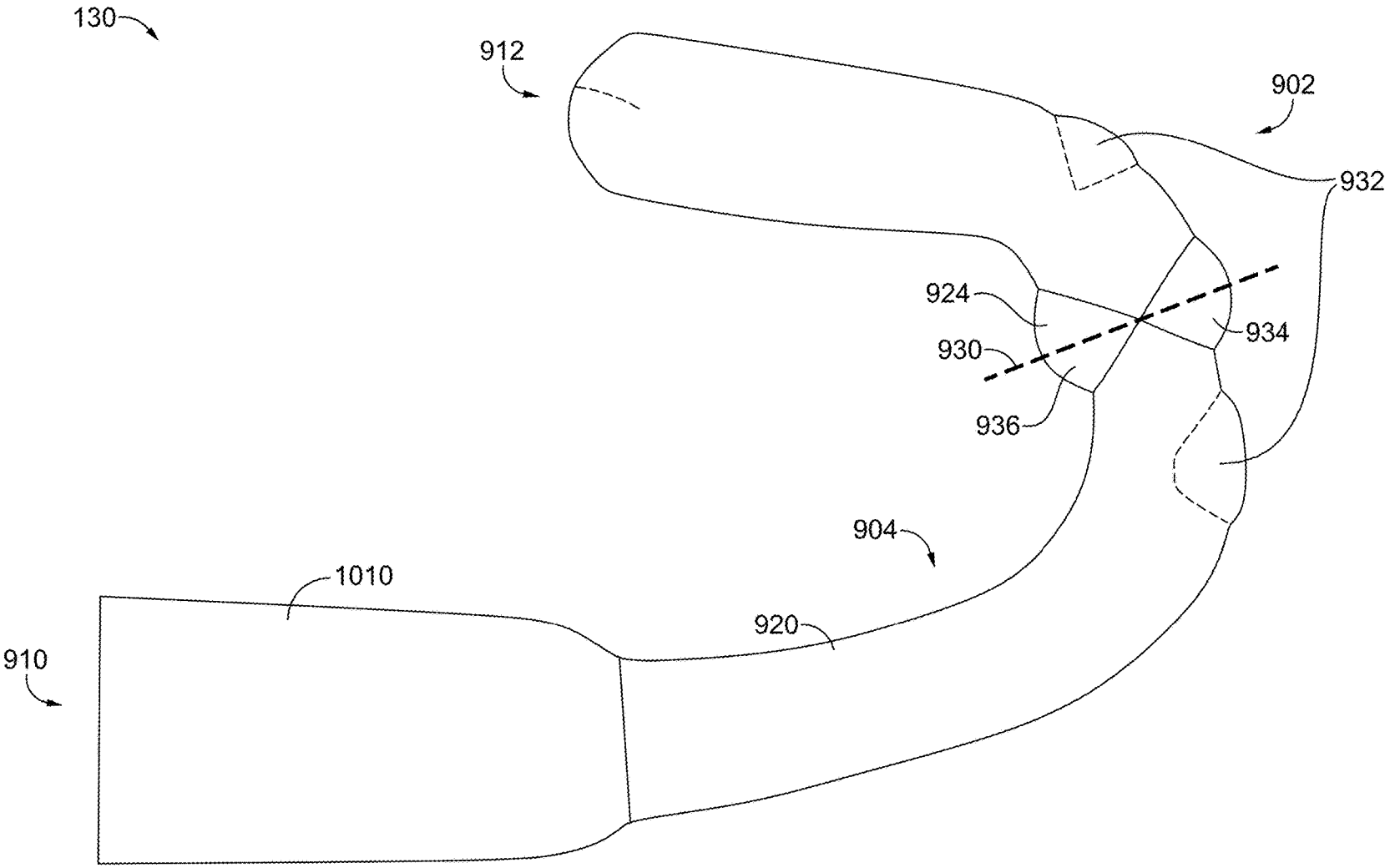
FIG. 11 is a depiction of the example knitted component of FIGS. 10A and 10B, in accordance with aspects herein.

In aspects, the knitted component 130 can include a single seam as it is formed into the upper 110. Particularly, in some examples, the underfoot portion 115 of the knitted component 130 may include a seam 132 located generally in the forefoot region 118. In the example shown in FIG. 3, the seam 132 extends from the toe end 119 towards the midfoot region 120. In aspects, the seam 132 may terminate before the midfoot region 120. The seam 132 may generally extend longitudinally in that it extends in a direction from the forefoot region 118 towards the midfoot region 120. In FIG. 11, it can be seen that the seam 132 can extend continuously from the underfoot portion 115 to the overfoot portion 114 at the toe end 119 as seen in FIG. 4B. In other examples, the seam 132 may extend in a different direction, such as horizontally or may curve around the toe end 119 from the medial side 124 to the lateral side 126. The seam 132 represents a location at which at least two edges of the knitted component 130 are joined and secured through sewing, bonding (e.g., with fusible materials), adhering, and the like.

In aspects, the knitted component 130 may include a single knit layer. In other aspects, the knitted component 130 may include multiple knit layers. In one example of the latter, looking at FIG. 5, the knitted component 130 is shown including a first knit layer 140 and a second knit layer 150. The first knit layer 140 and the second knit layer 150 may both have a generally similar shape such that both generally cover the same regions of the upper 110. Particularly, the first knit layer 140 and the second knit layer 150 may have a sock-like construction as described above.

Figure 5:
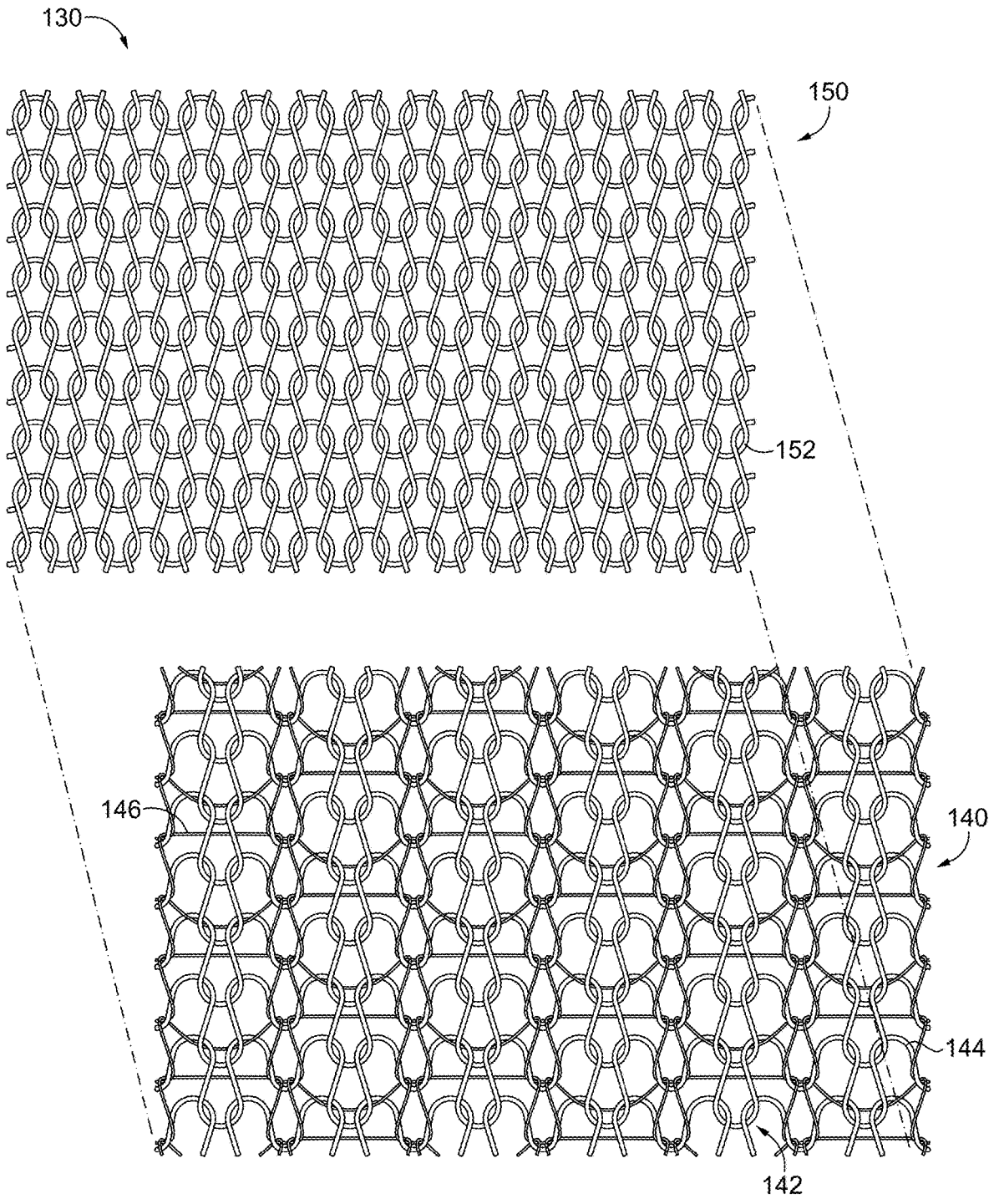
FIG. 5 depicts a close-up view of part of a knitted component forming part of the upper of FIGS. 1A and 1B, in accordance with aspects herein.

FIG. 5 depicts a schematic representation and an exploded view of portions of the knit layers 140, 150. The first knit layer 140 may include a first set of yarns 142 interlooped together to form a plurality of knit courses, and the second knit layer 150 may include a second set of yarns 152 interlooped together to form a plurality of knit courses. Herein, the term "set of yarns" may include a single end of yarn, multiple ends of yarns running through the same feeder and being knit as a single unit, or multiple ends of yarns being knit separately. The first set of yarns 142 may include a low-melting thermoplastic material having a lower melting temperature than material(s) of the second set of yarns 152.

Figure 6:
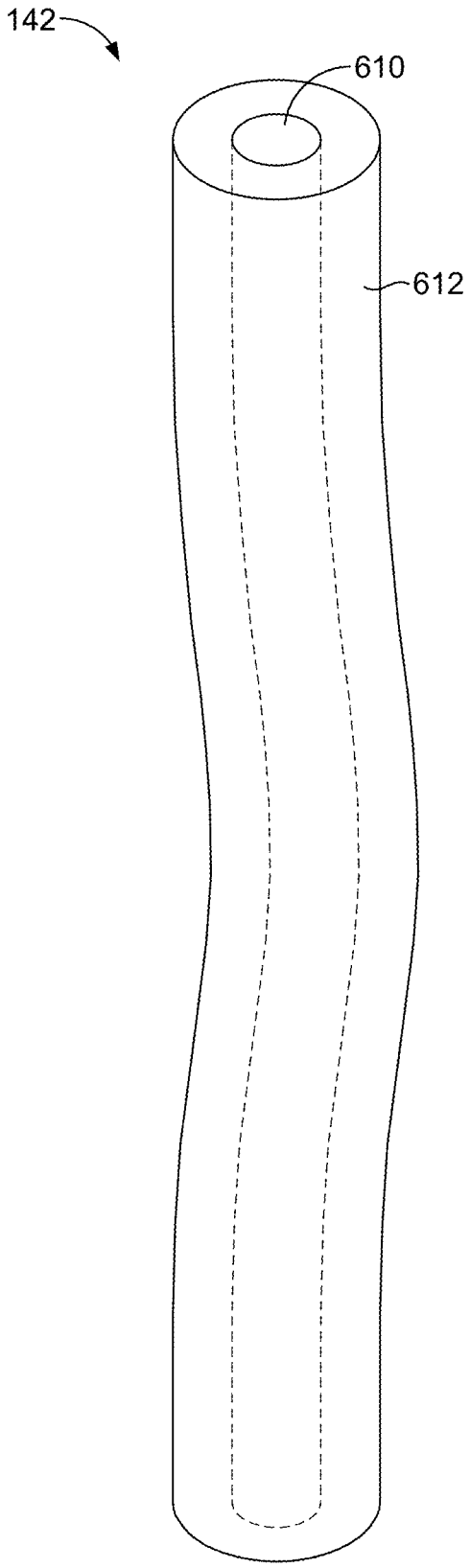
FIG. 6 depicts a configuration of a yarn that can be incorporated into a knitted component, e.g., the one shown in FIG. 5, in accordance with aspects herein.

The low-melting thermoplastic material may be a component of a multi-component yarn within the first set of yarns 142. For example, the first set of yarns 142 may include a multi-component yarn, e.g., core-sheath yarn 144, having a first component that is the low-melting thermoplastic material and a second component that is a material with a higher melting temperature. In aspects, this yarn can be a core-sheath yarn (as shown in this example) having a core of a first type of material (e.g., a first yarn component) surrounded by a sheath of a second type of material (e.g., a second yarn component). One non-limiting example of a core-sheath yarn is shown in FIG. 6, which depicts a core 610 extending longitudinally along a length of the yarn and a sheath 612 that surrounds the core 610. It should be understood that a core-sheath yarn may include a yarn formed by coating a core with a sheath polymer or co-extruding a core and sheath together to form a monofilament core-sheath yarn. With respect to the first set of yarns 142, the sheath 612 may include a thermoplastic material having a melting point lower than a melting point of the core 610. For example, the sheath 612 may include a synthetic polymeric material formed from a polymer that melts at relatively lower temperatures. In example aspects, the sheath 612 can include a thermoplastic polyurethane (TPU), a thermoplastic polyethylene (TPE), or another synthetic polymeric material having a lower melting temperature than a material of the core 610. The core 610 can be a high-melting polymer yarn including polyethylene terephthalate (PET) yarns (commonly known as polyester), recycled PET yarns, polyamide yarns (commonly known as nylon), elastane yarns, and other higher-melting synthetic yarns. In some aspects, the first set of yarns 142 includes a single end of yarn or at least a single type of yarn (e.g., the core-sheath yarn 144 or another bi-component yarn). In other aspects, the first set of yarns 142 can include other types of yarns. For example, the first set of yarns 142 can include a monofilament yarn 146, e.g., a thermoplastic polyurethane monofilament or a polyester monofilament. The thermoplastic polymer of the monofilament yarn 146 may also be a low-melting polymer. This monofilament yarn 146 may have a smaller diameter than the yarn 144.

The second set of yarns 152 can include a yarn having a higher melting temperature than the low-melting component (e.g., the sheath of the low-melting thermoplastic material) of the first set of yarns 142. In examples where the first set of yarns 142 comprises a monofilament yarn 146, the second set of yarns 152 may also have a greater melting temperature than the monofilament yarn 146 of the first set of yarns 142. The second set of yarns 152 can have a higher tenacity than the yarn of the first set of yarns 142. The second set of yarns 152 may have a tenacity that is greater than 5 g/D. While not shown, the second set of yarns 152 may include another yarn that is a sewing thread that is knit in with the other yarn(s) of the second set of yarns 152 to form at least some of the knit structure of the second knit layer 150. The second knit layer 150 may exclude at least the first set of yarns 142. Further, in some aspects, the first knit layer 140 may exclude the second set of yarns 152.

The first knit layer 140 and the second knit layer 150 may have different knit constructions in that they have different types of knit stitches and/or follow different patterns of knit stitches. In some aspects, the first knit layer 140 can have a pattern of knitted loop stitches, tuck stitches, and float stitches; in some aspects, the first knit layer 140 can be referred to as having a knitted mesh structure. The second knit layer 150 may include knitted loop stitches without floats or tucks. Additionally, the first knit layer 140 and the second knit layer 150 have different knit densities (e.g., knitted loops per square centimeter) in example aspects. The first knit layer 140 may have a first knit density, and the second knit layer 150 may have a second knit density that is greater than the first knit density. In some aspects, the first knit density is between about 50% to 75% of the second knit density. Alternatively, the second knit layer 150 may include a knitted mesh structure that includes a pattern of knitted loop stitches, tuck stitches, and float stitches, where the first knit layer 140 may have knitted loop stitches without floats or tucks. In these alternative examples, the second knit density of the second knit layer 150 may be less than the first knit density of the first knit layer 140, and the second knit density may be between about 50% to 75% of the first knit density. Additionally, in some aspects, the first knit layer 140 and the second knit layer 150 may each comprise a single knit layer; although it is contemplated that they may be different in other examples.

Figure 7:
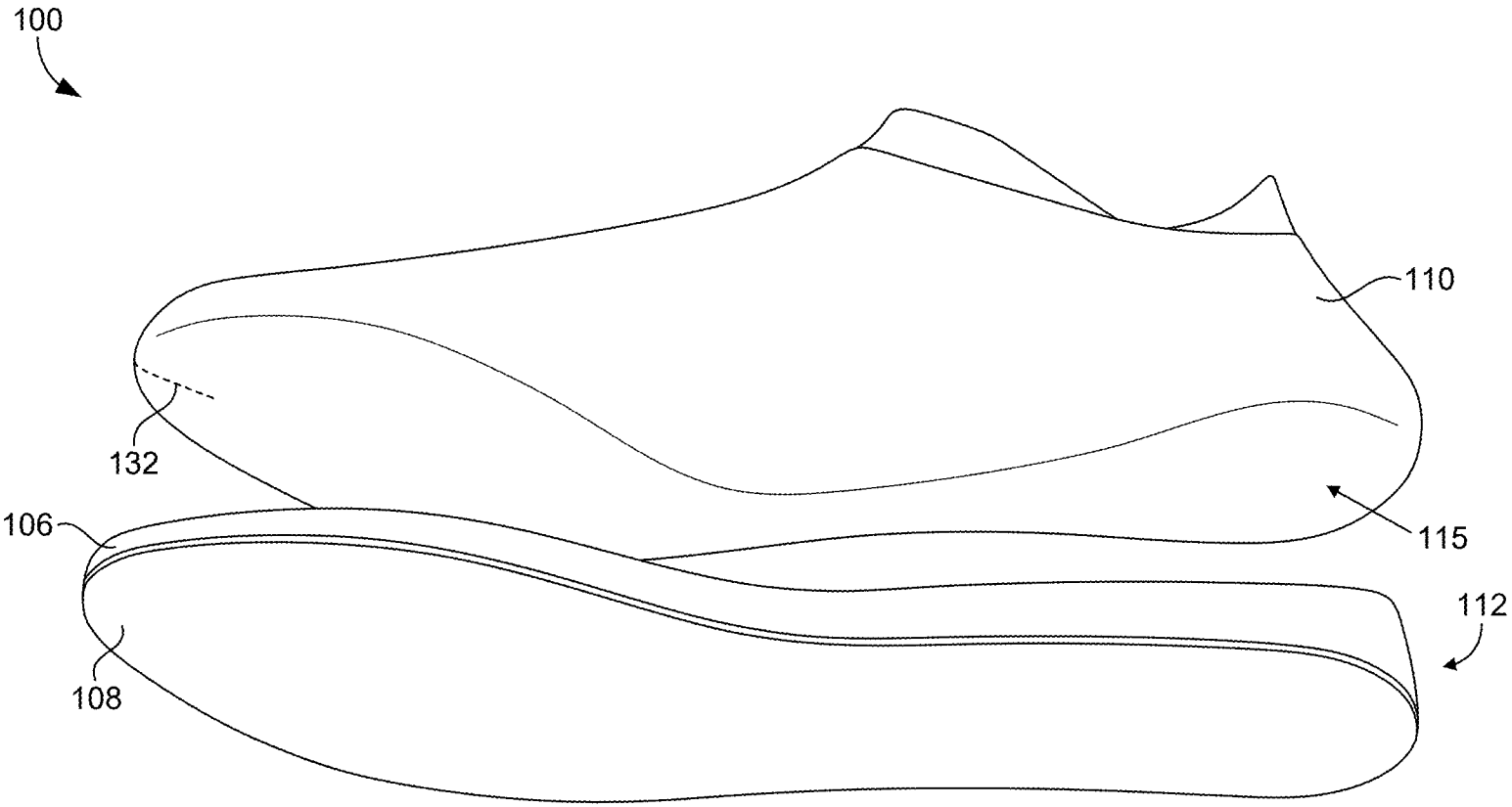
FIG. 7 depicts a partially exploded view of an article of footwear that includes an upper, e.g., one similar to that shown in FIGS. 1A and 1B, in accordance with aspects herein.

Looking now at FIG. 7, an exploded view of the article of footwear 100 with the upper 110 is shown, in accordance with aspects herein. The article of footwear 100 is shown in the form of an athletic shoe but other types of shoes (e.g., sandals, leisure shoes, and the like) are contemplated herein.

The upper 110 is secured to a sole structure 112. Specifically the underfoot portion 115 of the upper 110 may be secured to the sole structure 112 such that the underfoot portion 115 of the upper 110 overlays and directly abuts a top surface of the sole structure 112. As such, the article of footwear 100 may lack a separate strobel.

The sole structure 112 may include a midsole and/or outsole. For example, the sole structure 112 can include a midsole 106 that is joined to the underfoot portion 115 of the upper 110. The midsole 106 can be formed from a compressible polymer foam element (e.g., a polyurethane or ethylvinylacetate foam) that attenuates ground reaction forces (e.g., provides cushioning) when compressed between the foot and the ground during walking, running, or other ambulatory activities. Additionally or alternatively, the midsole 106 may incorporate plates, moderators, fluid-filled chambers, lasting elements, and/or motion control members that further attenuate forces, enhance stability, or influence the motions of the foot.

In some aspects, the sole structure 112 may also include an outsole 108. The outsole 108 provides a ground-engaging surface for the article of footwear 100 and can form a lower surface of the midsole 106 (or a lower surface of upper 110 in alternative examples). The outsole 108 may be at least partially formed with a textured wear-resistant material, e.g., a rubber material, thus providing a tread element to impart traction. Further, in aspects, the outsole 108 may include spike traction elements.

In aspects described herein, the article of footwear 100 or others may include additional elements layered on top of the upper 110 including, without limitation, leather materials, synthetic leather materials, knitted textiles, woven textiles, non-woven textiles, polymer skins, polymer sheets, adhesives (e.g., meltable adhesives or glue), or combinations of the same, and the like. These additional elements can be positioned at discrete locations on the upper 110 including, for example, the toe end 119 (e.g., a toe cap), the heel end 123 (e.g., a heel counter), and the like.

Figure 8:
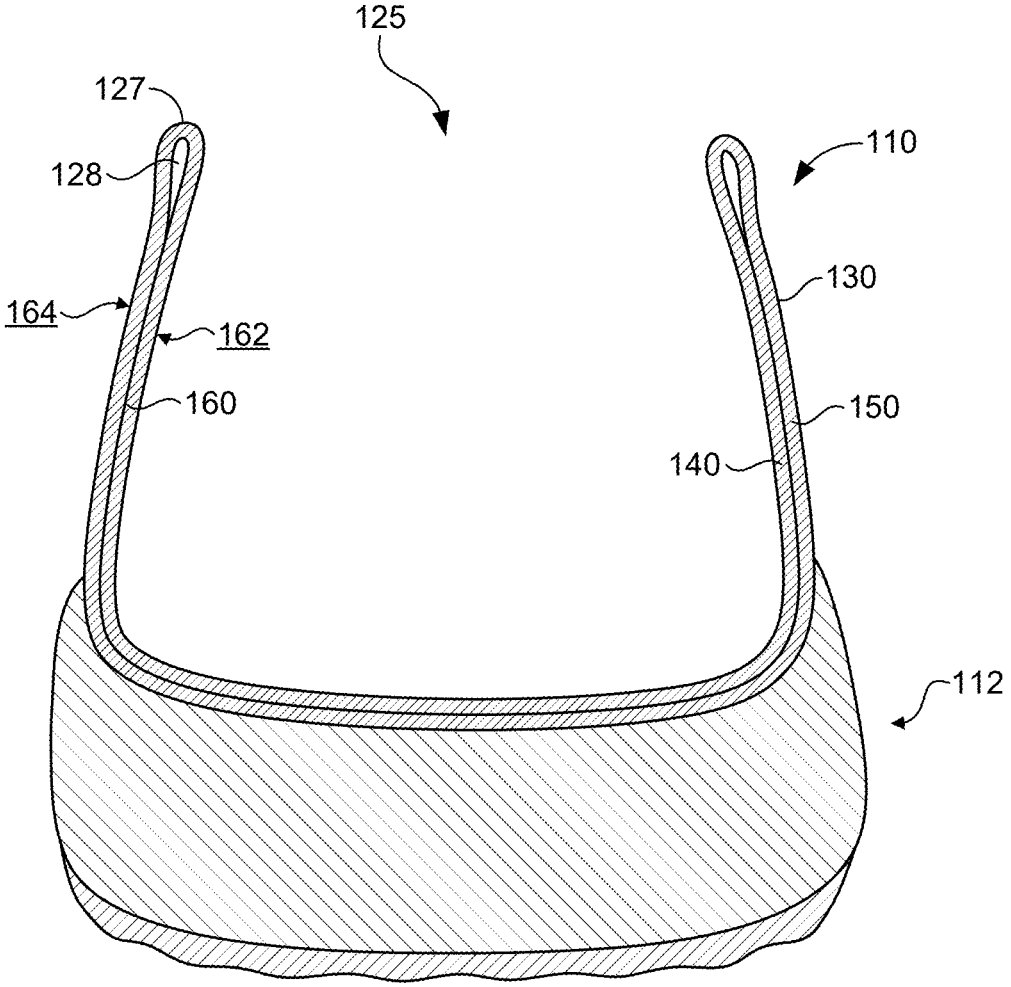
FIG. 8 depicts a cross-section of the article of footwear of FIG. 7, in accordance with aspects herein.

FIG. 8 depicts a schematic cross-section of the article of footwear shown in FIG. 7. In this depicted aspect, the knitted component 130 has a dual-layer construction that includes the first knit layer 140 and the second knit layer 150. As shown in FIG. 8, the first knit layer 140 can form an inner-facing surface 162 of the knitted component 130 and the second knit layer 150 can form an outer-facing surface 164 of the knitted component 130. Thus, the first knit layer 140 may be interior to the second knit layer 150 when the knitted component 130 forms the upper 110. In some aspects, an additional liner may be provided that abuts the first knit layer 140, although some of the inner-most surface of the upper 110 may still be formed by the first knit layer 140, in such aspects. In other aspects, the entire or substantially the entire inner-most surface of the upper 110 can be formed by the first knit layer 140. Similarly, the outer-most surface of the upper 110 may be entirely or substantially entirely the second knit layer 150 and, in some aspects, includes one or more other components layered thereon. The schematic cross-section of FIG. 8 shows the first knit layer 140 forming the inner-facing surface 162. However, in other aspects, the first knit layer 140 may form the outer-facing surface 164 and the second knit layer 150 may form the inner-facing surface 162. In other words, in aspects herein, the first and second knit layers 140, 150 can be reversed in position.

In at least some areas of the upper 110, the first knit layer 140 and the second knit layer 150 may be bonded together via a thermoplastic polymer layer 160. The thermoplastic polymer layer 160 may be formed from a thermoplastic polymer material that was melted in the knit layers 140 or 150 and then cooled. The thermoplastic polymer materials can be provided via the yarns of the knit layers 140 and/or 150. In some aspects, the thermoplastic polymer layer 160 includes the low-melting thermoplastic polymer material melted from a first yarn component of the first set of yarns 142 of the first knit layer 140. In other words, in some aspects, the sheath 612 in FIG. 6 of the core-sheath yarn 144 may be melted after knitting and the melted thermoplastic polymer material may flow so that it at least partially encapsulates the remaining (un-melted) yarn component of the core-sheath yarn 144 of the first knit layer 140 and the yarn 152 of the second knit layer 150. When the thermoplastic polymer layer material cools, the first knit layer 140 and the second knit layer 150 may be secured together wherever the thermoplastic polymer layer 160 at least partially encapsulates the yarn of the first knit layer 140 and the second knit layer 150. In some aspects, the thermoplastic polymer layer 160 may fully encapsulate the remaining (un-melted) portions of the first set of yarns 142 and only partially encapsulate the second set of yarns 152.

The first knit layer 140 and the second knit layer 150 may be bonded via the thermoplastic polymer layer 160 throughout a portion or substantially all of the underfoot portion 115 of the upper 110. The first knit layer 140 and the second knit layer 150 may be bonded via the thermoplastic polymer layer 160 throughout a portion or substantially all of the overfoot portion 114 of the upper 110. In some aspects, the thermoplastic polymer layer 160 may extend through the forefoot region 118, the midfoot region 120, and the heel region 122. In some aspects, thermoplastic polymer layer 160 may also extend through the throat region 134. In some aspects, the thermoplastic polymer layer 160 may extend throughout most of the upper 110 except in the collar 128. In other aspects, the thermoplastic polymer layer 160 extends throughout the entire upper 110.

Looking at the cross-section of FIG. 8, the knitted component 130 may be an integrally knit textile such that the first knit layer 140 and the second knit layer 150 are formed via the same knitting process. In such examples, the first knit layer 140 and the second knit layer 150 may be integrally joined together along a common knit element 127. The common knit element 127 may be located along the ankle opening 125 of the upper 110. As further described with respect to FIGS. 12A and 12B, the knitted component 130 may be folded over itself so that the second knit layer 150 overlays the first knit layer 140 or vice versa. In this way, the common knit element 127 may represent a fold in the knitted component 130.

In some portions, the collar 128 extending around the ankle opening 125 may be portions of the first knit layer 140 and the second knit layer 150 but may have different yarns(s) and/or different knit constructions than the rest of the first knit layer 140 and the second knit layer 150. For example, in some areas, at the collar 128, the first knit layer 140 and the second knit layer 150 may have the same yarn and knit constructions; whereas, the rest of the first knit layer 140 and the second knit layer 150 may have different sets of yarns (e.g., the first set of yarns 142 and the second set of yarns 152) and different knit stitches and patterns as described with respect to FIG. 5. In some aspects, a third set of yarns may be knit to form the first knit layer 140 and the second knit layer 150 at the collar 128. In example aspects, neither the first knit layer 140 nor the second knit layer 150 may include the core-sheath yarn 144 in the collar 128. In this way, the thermoplastic polymer layer 160 may be absent from the collar 128. The third set of yarns may only include yarns with higher melting temperatures than the first yarn component (e.g., sheath 612) of the core-sheath yarn 144 that may be used as the first set of yarns 142. In some examples, the third set of yarns knit in the first knit layer 140 and the second knit layer 150 in the collar 128 includes one or more elastic yarns, such as a polyester yarn with elastane.

In addition, the first knit layer 140 and the second knit layer 150 may be at least partially separable in the collar 128. For example, in some aspects, the first knit layer 140 and the second knit layer 150 may be joined along the ankle opening 125 via the common knit element 127 but may otherwise be separable in the collar 128.

Figure 9A:
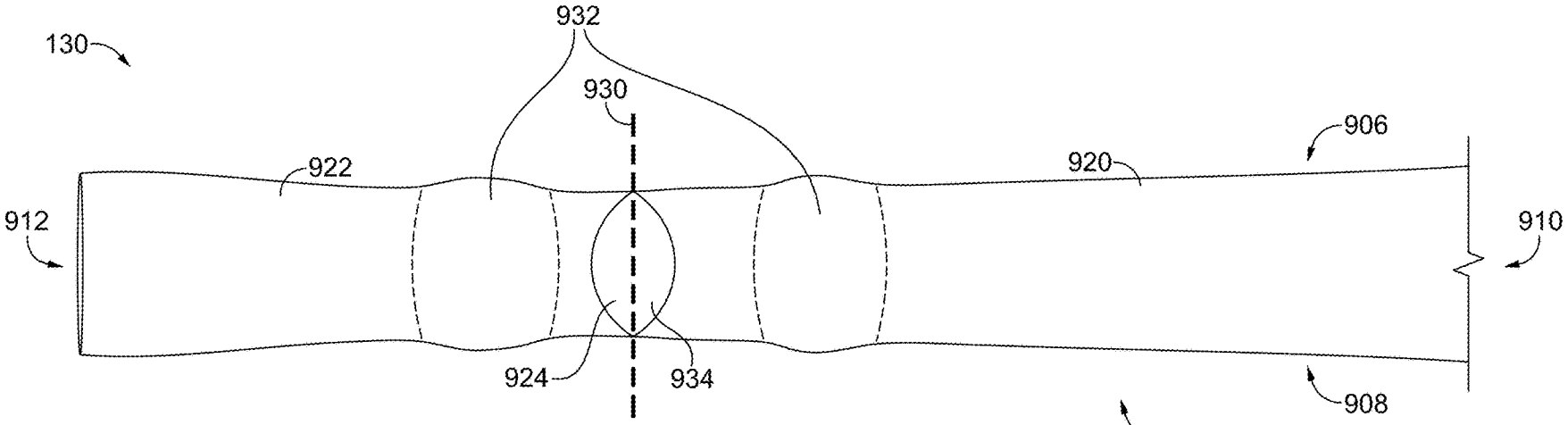
FIGS. 9A and 9B depict opposite sides of a knitted component that can form part or all of an upper, being shown in an unfolded configuration, in accordance with aspects herein.
Figure 9B:
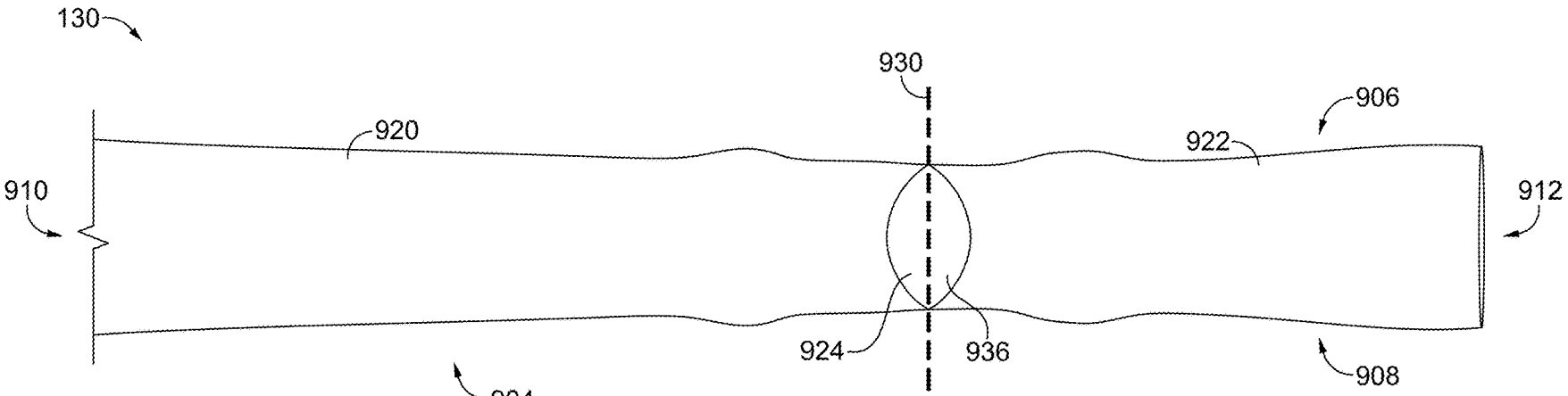

FIGS. 9A and 9B show one configuration of the knitted component 130 after knitting and prior to being formed into an upper 110 and prior to creation of the thermoplastic polymer layer 160. In this example, after knitting, the knitted component 130 has a generally tubular structure as shown in FIGS. 9A and 9B. FIG. 9A depicts a first side 902 of the knitted component 130 that generally corresponds to the underfoot portion 115 of the upper 110, and FIG. 9B depicts the opposite second side 904 of the knitted component 130 that generally corresponds to the overfoot portion 114 of the upper 110. It should be understood, however, that the overfoot portion 114 may generally have a larger width of the knitted component 130 than the underfoot portion 115 such that the first side 902 shown in FIG. 9A may correspond to a bottom area of the overfoot portion 114.

The tubular structure of the knitted component 130 may be formed on any suitable knitting machine, including a v-bed flat knitting machine, or a circular knitting machine. In example aspects, the knitted component 130 is formed on a flat knitting machine, which can enable various portions of the knitted component 130 to have different diameters. With a flat knitting machine, the first side 902 of the knitted component 130 shown in FIG. 9A may generally be formed on a first needle bed, and the second side 904 of the knitted component 130 shown in FIG. 9B may generally be formed on a second needle bed. The first side 902 and the second side 904 may be joined together along the longitudinal sides 906 and 908 of the tubular structure but may otherwise be generally unsecured together.

In this aspect, after knitting, the knitted component 130 has a generally tubular structure with a first end 910 and a second end 912 opposite the first end 910. The knitted component 130 includes a first knit portion 920 at the first end 910 and a second knit portion 922 at the second end 912. In accordance with aspects herein, the knitted component 130 may generally fold over itself, along fold line 930 so that the first knit portion 920 overlays the second knit portion 922 or vice versa. In this way, the first knit portion 920 forms at least part of the first knit layer 140 when the upper 110 is formed, and the second knit portion 922 forms at least part of the second knit layer 150 when the upper 110 is formed. The fold line 930 may form the ankle opening 125 of the upper 110.

In some aspects, the first knit portion 920 forms the entirety of the first knit layer 140 and the second knit portion 922 forms the entirety of the second knit layer 150. In other aspects, the knitted component 130 after knitting includes a third knit portion 924 between the first knit portion 920 and the second knit portion 922 that forms a portion of the first knit layer 140 and a portion of the second knit layer 150 when the upper 110 is formed. In particular, the third knit portion 924 may form the first knit layer 140 and the second knit layer 150 at the collar 128 of the upper, and the rest of the first knit layer 140 may be formed by the first knit portion 920 and the rest of the second knit layer 150 may be formed by the second knit portion 922. In the aspect of FIGS. 9A and 9B, the third knit portion 924 extends over the fold line 930.

The first side 902 and the second side 904 of the knitted component 130 may be secured together at one or more ends (e.g., first end 910 and/or the second end 912) of the knitted component 130. In one example, both the first end 910 and the second end 912 are secured together so that the knitted component 130 forms a closed-off tubular structure. In other examples, one of the ends 910 or 912 may be closed off while the other may remain open, and in yet other examples, both ends 910 and 912 may remain open. The first and second ends 910 and 912 may be secured together during knitting or may be secured together in a post-knitting process, such as by stitching.

While generally tubular in structure, the knitted component 130 may not be a perfectly symmetrical tubular structure as the knitted component 130 may include short rows in some locations to create shaping. For example, the first side 902 of the knitted component corresponding to the underfoot portion 115 may include heel pockets 932 in the first knit portion 920 and the second knit portion 922 to form curve-shaped structures in the first knit layer 140 and the second knit layer 150 in the heel region 122 of the upper 110 to help conform or fit around a wearer's heel. The heel pockets 932 may be created with partial-length courses to isolate additional material for creation of a pocket structure. In some aspects, the portion of the knitted component 130 that has the relatively lower knit density may have a greater knit density in its heel pocket 932 than in than the rest of that knit portion. For example, if the first knit portion 920, corresponding to the first knit layer 140, has a lower knit density than the second knit portion 922, the heel pocket 932 in the first knit portion 920 may have a higher knit density than the rest of the first knit portion 920. The higher knit density at the heel pocket 932 may create additional material and structure for the portion of the knitted component 130 that curves around the user's heel to increase durability and potentially comfort.

In additional aspects, the first side 902 of the knitted component 130 may include a heel tab pocket 934 to provide additional material to form the heel tab 117 extending outward from the ankle opening 125 in the heel region 122, and the second side 904 of the knitted component 130 may similarly include a tongue tab pocket 936 to provide additional material to form the tongue tab 116 extending outward from the ankle opening 125 in the throat region 134. In aspects having the third knit portion 924, the heel tab pocket 934 and the tongue tab pocket 936 may both be formed within the third knit portion 924. In other aspects without a third knit portion 924, the first knit portion 920 may form half of the heel tab pocket 934 and half of the tongue tab pocket 936 while the second knit portion 922 may form the other halves of the heel tab pocket 934 and the tongue tab pocket 936.

Figure 10A:
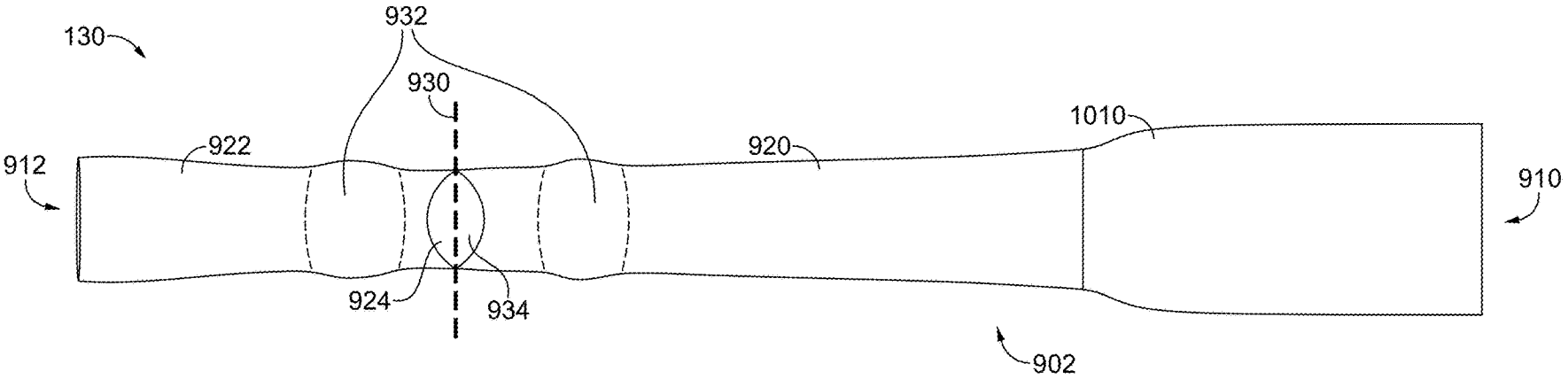
FIGS. 10A and 10B depict opposite sides of a knitted component that can form part or all of an upper, being shown in an unfolded configuration, in accordance with aspects herein.
Figure 10B:
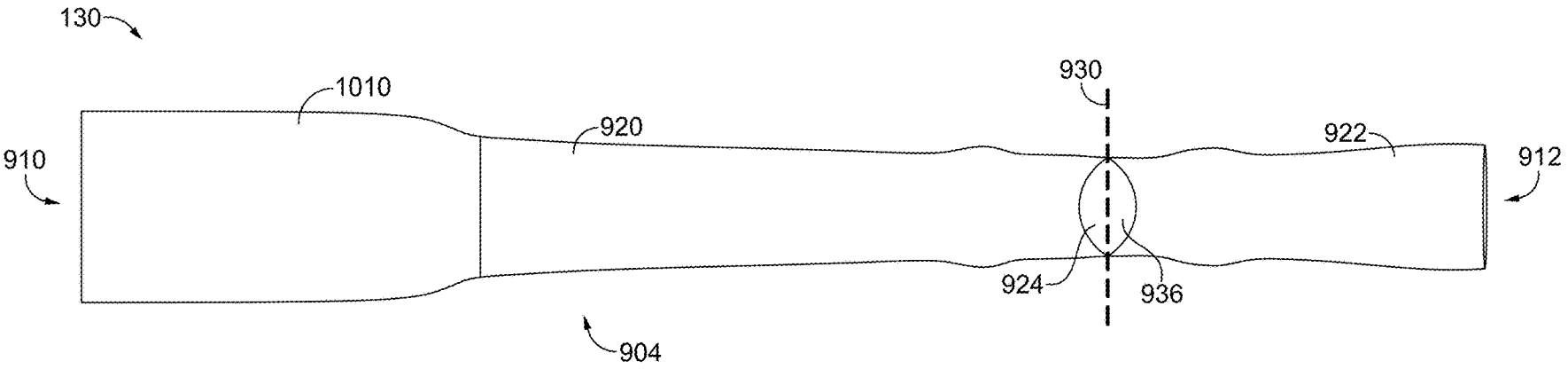

FIGS. 10A and 10B depict an alternative example of the knitted component 130 after knitting and prior to forming the thermoplastic polymer layer 160. FIG. 10A depicts the first side 902. FIG. 10B depicts the second side 904. The knitted component 130 depicted in FIGS. 10A and 10B are the same as described with respect to FIGS. 9A and 9B except that the knitted component 130 further includes a fourth knit portion 1010 adjacent the first knit portion 920. The fourth knit portion 1010 may have different yarns and/or different knit constructions as the first knit portion 920. For example, the fourth knit portion 1010 may not have the core-sheath yarn 144, nor does the fourth knit portion 1010 otherwise have the low-melting thermoplastic polymer material that is melted to form the thermoplastic polymer layer 160. In addition, the fourth knit portion 1010 may have a non-tubular construction. For example, the fourth knit portion 1010 may have a single knit construction or may have a double knit construction where the two layers are interconnected such that they cannot be separated as in the first knit portion 920, second knit portion 922, and the third knit portions 924. While the rest of the features of FIGS. 9A and 9B apply to the example in FIGS. 10A and 10B, such details are not repeated here for sake of brevity. The fourth knit portion 1010 may be waste yarn that is removed from the knitted component 130 prior to forming the knitted component 130, or can be folded or otherwise integrated at least in part into the upper 110.

FIG. 11 is a different view of the knitted component 130 depicted in FIGS. 10A and 10B. The knitted component 130 in FIG. 11 is rotated approximately 90 degrees so that a portion of the first side 902 and a portion of the second side 904 are both visible. In addition, the tubular structure is allowed to curve following the curvature of the knitted component 130 instead of being stressed to a generally straight configuration. This curved arrangement of the knitted component 130 depicted in FIG. 11 helps to illustrate how it may fit around a wearer's foot. Although this view is provided for the knitted component 130 depicted in FIGS. 10A and 10B, it should be understood that the shaping and other details shown with respect to the first knit portion 920, second knit portion 922, and the third knit portion 924 shown in FIG. 11 also applies to the example of the knitted component 130 in FIGS. 9A and 9B.

Figure 12A:
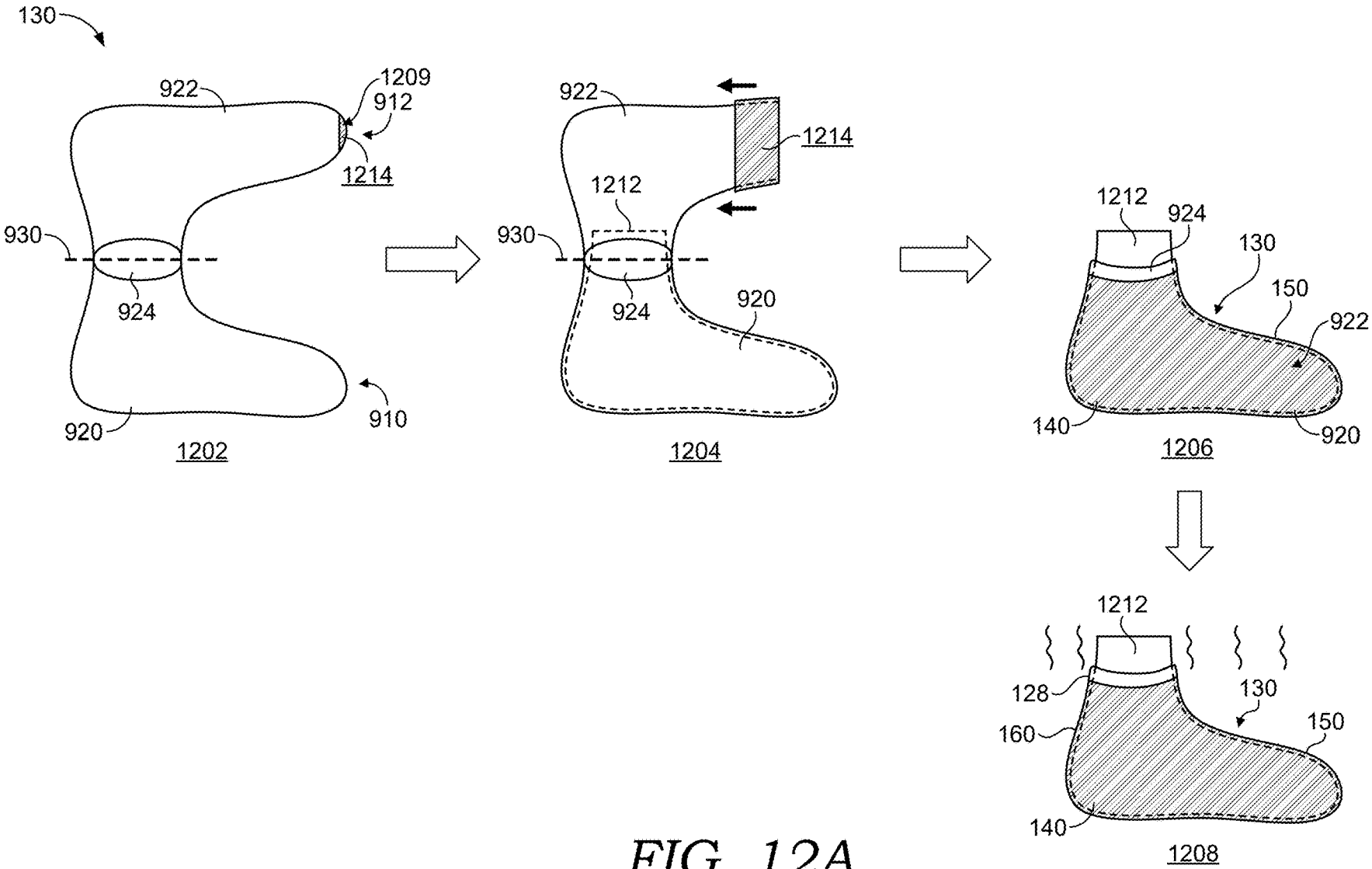
FIGS. 12A and 12B depict an example process for forming an upper, e.g., similar to that shown in FIGS. 1A and 1B, in accordance with aspects herein.

Looking now at FIG. 12A, a sequential depiction of a process of manufacturing an upper, e.g., in this example the upper 110, is shown, in accordance with aspects herein. The order and processing of the upper 110 shown in FIG. 12A is intended to represent just one non-limiting example. In step 1202, the knitted component 130 is formed, including the first knit portion 920, the second knit portion 922, and the third knit portion 924. In some aspects, the knitted component 130 may be formed using a flat knitting machine. In other aspects, the knitted component 130 may be formed using a circular knitting machine. Further, the second end 912 may be opened so that there is an opening 1209 into the tubular structure of the knitted component 130. The second end 912 may have been left open during the knitting process or may have been closed via knitting and then cut later to crate the opening 1209.

In step 1204, the knitted component 130 may be folded. This folding may be performed while a last 1212 is inserted into the knitted component 130. The folding can include folding the second knit portion 922 down over the first knit portion 920 while the first knit portion 920 is surrounding the last 1212. In step 1204, the second knit portion 922 is essentially turned inside out so that the outer-facing surface 1214 that is an interior surface when the knitted component 130 is in a tubular form after knitting becomes an outer-facing surface 1214. The second knit portion 922 may be folded down until fold line 930. It should be understood that, in other aspects, the first knit portion 920 may be folded down over the second knit portion 922 in a similar manner so that the first knit layer 140 formed by the first knit portion 920 is an outer-facing layer (e.g., exterior knit layer) and the second knit layer 150 formed by the second knit portion 922 is an inner-facing layer (e.g., interior knit layer).

In step 1206, the knitted component 130 is shown substantially fully folded over onto itself to create two layers. That is, the first knit layer 140 is at least partially formed from the first knit portion 920, and the second knit layer 150 is at least partially formed from the second knit portion 922. In some aspects, once folded over in step 1206, the wales of the first knit layer 140 may not align with the wales of the second knit layer 150. That is, wales of the first knit layer 140 may be offset from wales of the second knit layer 150. This offset alignment may continue through the rest of the process and be present in the completed upper 110.

In step 1208, heat, and in some aspects pressure, may be applied to the folded knitted component 130 to melt the thermoplastic polymer material in the first knit layer 140 and form the thermoplastic polymer layer 160. This step bonds the first knit layer 140 and the second knit layer 150 where the thermoplastic polymer layer 160 is present, which may be substantially everywhere except the collar 128 formed by the third knit portion 924. The step 1208 may be performed while the folded knitted component 130 is still on the last 1212.

Figure 12B:
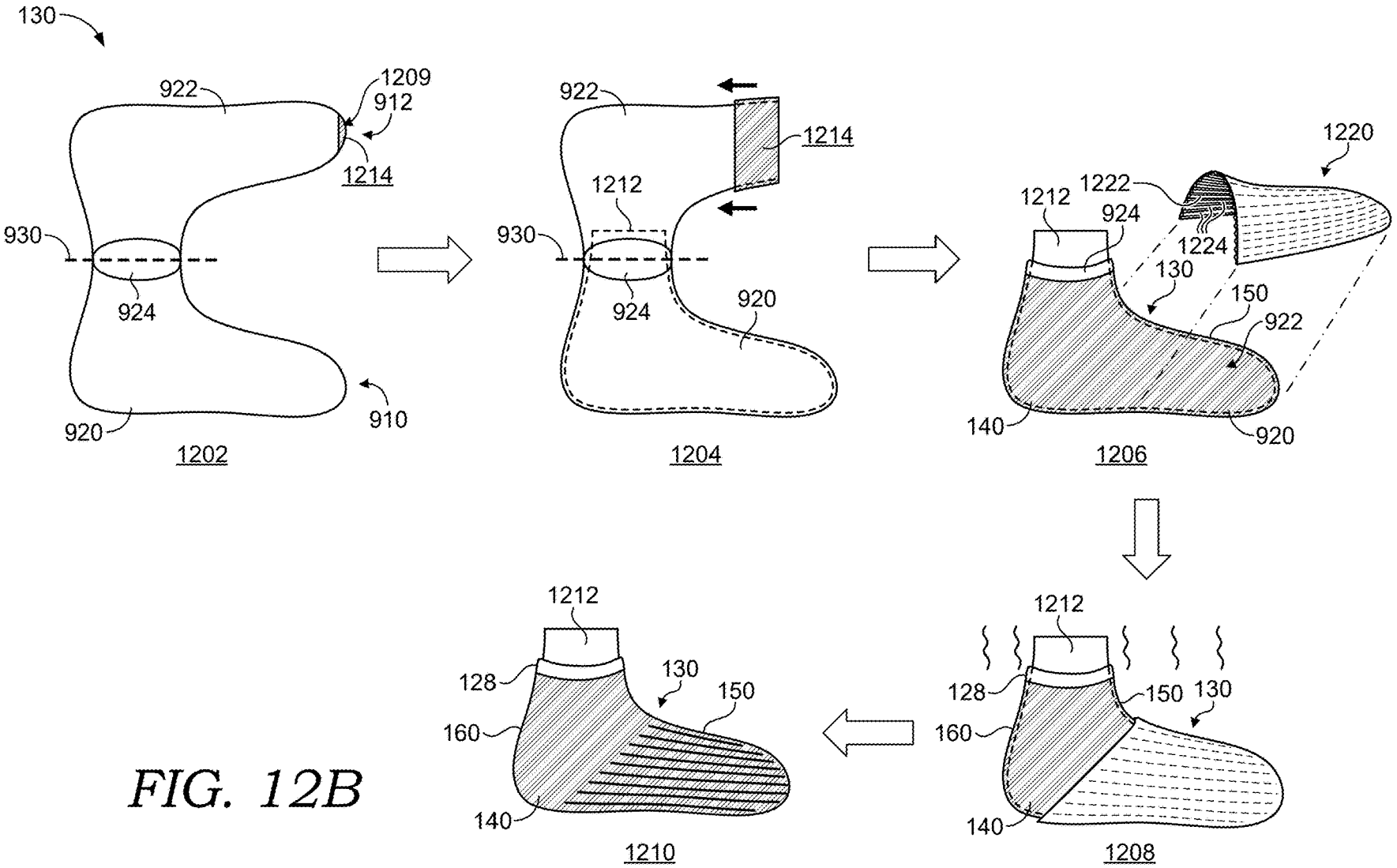

Looking now at FIG. 12B, another schematic depiction of a process of manufacturing an upper, e.g., in this case the upper 110, is shown, in accordance with aspects herein. The steps 1202 and 1204 in FIG. 12B can be the same as in FIG. 12A and thus are not repeated here.

In step 1206, the knitted component 130 is shown completely folded over onto itself to create two layers. That is, the first knit layer 140 is at least partially formed by the first knit portion 920, and the second knit layer 150 is at least partially formed by the second knit portion 922. This is similar to FIG. 12A. However, in FIG. 12B, the step 1206 also shows a bottom perspective view of a molding cover 1220. The molding cover 1220 can have different shapes but it is generally configured to be placed at least partially over whatever knit layer (e.g., the first knit layer 140 or the second knit layer 150) is positioned on the exterior side. The interior surface 1222 of the molding cover 1220 includes one or more molding features 1224, which may be either positive or negative structures that will create a texture on the exterior knit layer in conjunction with the application of heat and/or pressure and/or energy. In some examples, the molding features 1224 may be positive features, e.g., features that protrude from the interior surface 1222 of the molding cover 1220 and may create corresponding indentions in the knitted component 130. In other examples, the molding features 1224 are negative features that they are cavities or spaces extending into the interior surface 1222 of the molding cover 1220 and may result in protrusions being molding on the knitted component 130. In this example, the second knit layer 150 is positioned exterior to the first knit layer 140 to form the exterior knit layer, but in other examples, the first knit layer 140 may be positioned over the second knit layer 150 to form the exterior knit layer.

In step 1208, the molding cover 1220 is positioned over the exterior knit layer when the knitted component 130 is on the last 1212. As described with respect to step 1208 in FIG. 12A, heat and pressure may be applied to the folded knitted component 130 to melt the thermoplastic polymer material from the first knit layer 140 and form the thermoplastic polymer layer 160. This step can bond the first knit layer 140 and the second knit layer 150 where the thermoplastic polymer layer 160 is present, which may be substantially everywhere except the collar 128 formed by the third knit portion 924. The step 1208 in FIG. 12B may be performed while the folded knitted component 130 is still on the last 1212. In addition, heat and pressure may be applied to the molding cover 1220 positioned to cover part of the folded knitted component 130 in step 1208 in FIG. 12B to create texture on the folding knitted component. In step 1210 in FIG. 12B, the molding cover 1220 is removed to reveal the resulting molded features 1226 on the knitted component 130.

Although FIG. 12B shows the molding cover 1220 extending over the overfoot portion, in other examples, the molding cover 1220 may extend all the way around the upper or at least partially extend over the underfoot portion. In further examples, the molding cover 1220 may extend around the heel region. In other words, the molding cover 1220 can be shaped as desired to cover and manipulate any portion of the knitted component 130, e.g., forefoot portion, medial side, lateral side, heel portion, overfoot portion, underfoot portion, throat, and the like.

Figure 13A:
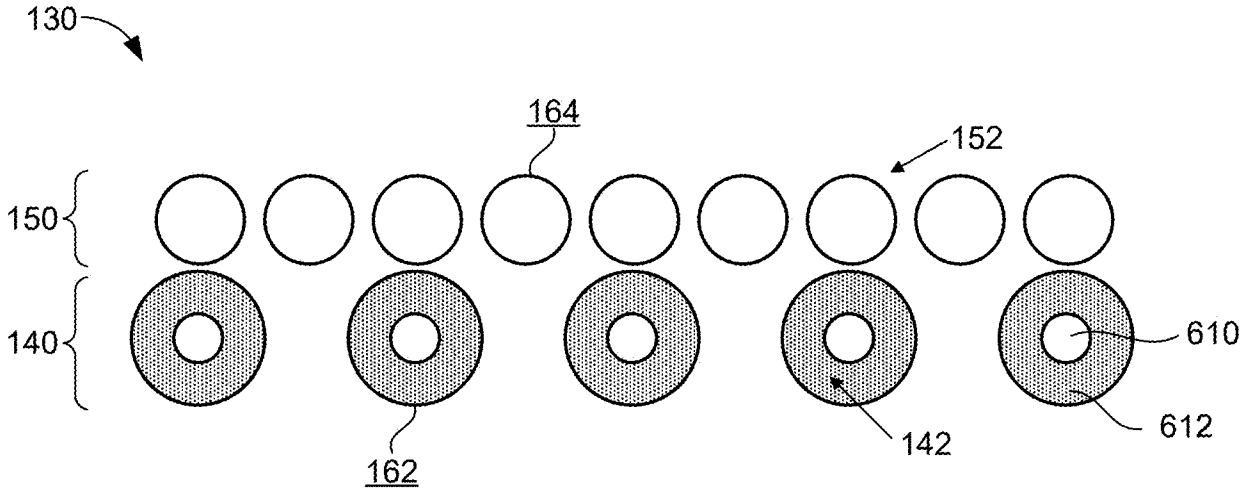
FIGS. 13A and 13B are cross-sections of a portion of a knitted component, e.g., such as that shown in FIG. 6, before and after application of heat and/or energy, in accordance with aspects herein.
Figure 13B:
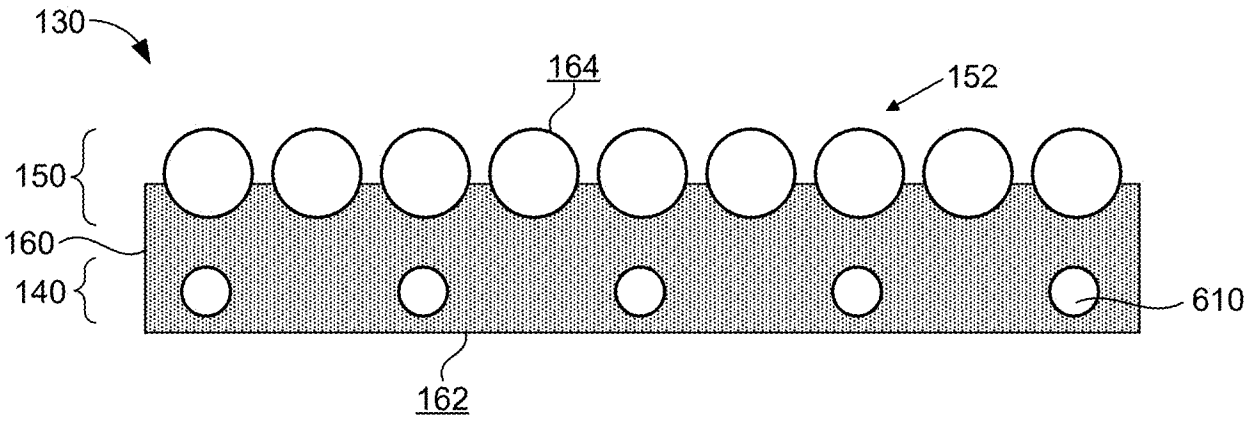

FIGS. 13A and 13B depict cross-sections of the knitted component 130 before and after a heating process, e.g., similar to that described in connection with step 1208 of FIGS. 12A and 12B. In FIG. 13A, the first knit layer 140 includes a first set of yarns 142 having a first yarn component (e.g., sheath 612) and a second yarn component (e.g., core 610) having a higher melting temperature than the first yarn component. The second knit layer 150 includes a second set of yarns 152 that also have a higher melting temperature than the first yarn component (e.g., sheath 612) of the first set of yarns 142. During heating, e.g., as in step 1208 in FIGS. 12A and 12B, the knitted component 130 is heated to a temperature that is at or higher than the melting temperature of the first yarn component (e.g., sheath 612) of the first set of yarns 142 in the first knit layer 140 and below the melting temperature(s) of the second yarn component (e.g., 610) in the first set of yarns 142 and the melting temperature of the second set of yarns 152. In this way, the thermoplastic material of the first yarn component (e.g., sheath 612) may melt while the second yarn component (e.g., core 610) of the first knit layer 140 and the second set of yarns 152 of the second knit layer 150 generally retain their shape and knitted structure.

FIG. 13B depicts the knitted component 130 as shown in FIG. 13A after applying heat (and in some aspects pressure), where a thermoplastic polymer layer 160 is formed from the melted first yarn component (e.g., sheath 612). In this example, the thermoplastic polymer layer 160 substantially fully encapsulates the second yarn component (e.g., core 610) of the first set of yarns 142 of the first knit layer 140 and partially encapsulates the second set of yarns 152 of the second knit layer 150 subsequent to heating. The thermoplastic polymer layer 160 may continuously extend along inner-facing surface 162 adjacent to the first knit layer 140 while the thermoplastic polymer layer 160 may not extend continuously on the outer-facing surface 164. In this way, the knitted structure of the second set of yarns 152 of the second knit layer 150 may provide a bumpy or non-smooth texture to the outer-facing surface 164, while the thermoplastic polymer layer 160 may form a smoother texture on the inner-facing surface 162.

Figure 13C:
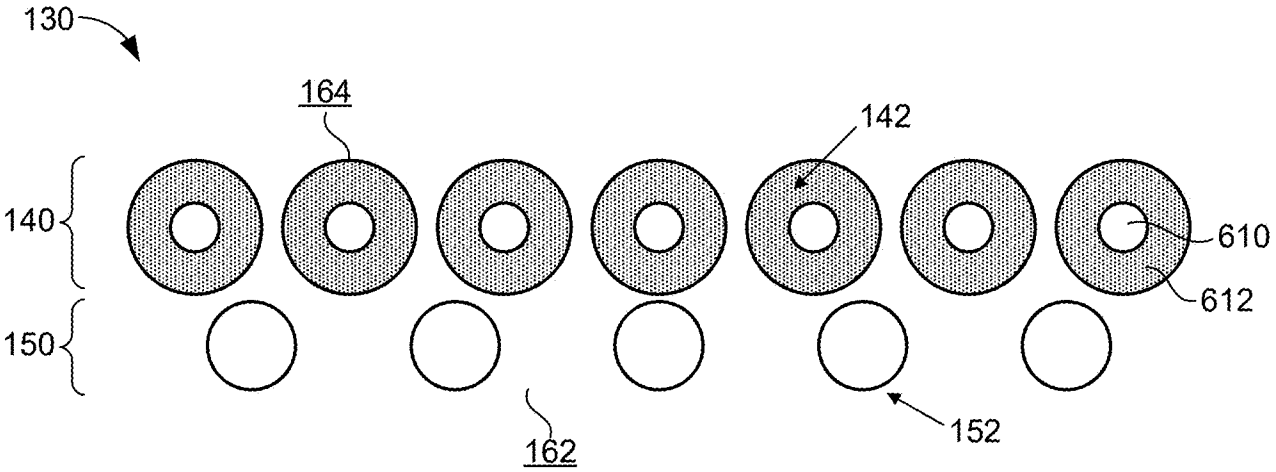
FIGS. 13C and 13D are cross-sections of a portion of a knitted component, e.g., such as that shown in FIG. 6, before and after application of heat and/or energy, in accordance with aspects herein.
Figure 13D:
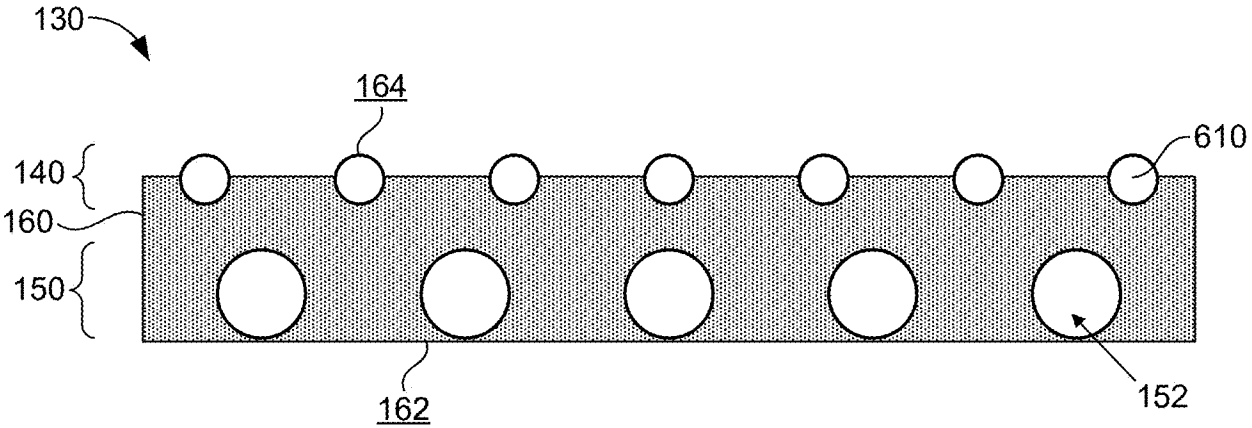

FIGS. 13C and 13D depict cross-sections of the knitted component 130 before and after application of heat, e.g., as in the step 1208 in FIGS. 12A and 12B. In FIG. 13C, the first knit layer 140 includes the first set of yarns 142 and the second knit layer 150 includes the second set of yarns 152 as described with respect to FIG. 13A. In FIG. 13C, however, the positions of the first and second knit layers 140 and 150 are opposite such that the first knit layer 140 is arranged on top of the second knit layer 150.

During heating, e.g., as described with respect to FIGS. 12A and 12B and FIGS. 13A and 13B, the thermoplastic material of the first yarn component (e.g., sheath 612) may melt while the second yarn component (e.g., core 610) of the first knit layer 140 and the second set of yarns 152 of the second knit layer 150 generally retain their shape and knitted structure. FIG. 13D depicts the knitted component 130 as shown in FIG. 13C after application of heat and pressure, where a thermoplastic polymer layer 160 is formed from the melted first yarn component (e.g., sheath 612). Notably, although the example knitted component 130 in FIG. 13C included the first knit layer 140 on top (which may be exterior), the thermoplastic polymer layer 160 may still be generally positioned to form a smooth surface on the opposite side (the bottom or interior surface) similar to as seen in FIG. 13B. In this example, the thermoplastic polymer layer 160 fully encapsulates the second set of yarns of 152 of the second knit layer and partially encapsulates the second yarn component (e.g., core 610) of the first set of yarns 142 of the first knit layer 140. Pressure applied during and/or immediately after heating may cause the thermoplastic polymer layer 160 to migrate towards and/or penetrate the second knit layer 150 to substantially fully encapsulate the second set of yarns so that the thermoplastic polymer layer 160 may continuously extend along the inner-facing surface 162 adjacent to the second knit layer 150 while not extending continuously on the outer-facing surface 164. In this way, the knitted structure of the second yarn component (e.g., core 610) of the first knit layer 140 may provide a bumpy or non-smooth texture to the outer-facing surface 164, while the thermoplastic polymer layer 160 may form a smoother texture for the inner-facing surface 162.

FIGS. 13A-13D also depict the different knit stitch densities in the first knit layer 140 and the second knit layer 150. Specifically, in the example shown in FIGS. 13A and 13B, the first knit layer 140 has a lesser knit density than the second knit layer 150. In the example shown in FIGS. 13C and 13D, the first knit layer 140 has a greater knit density than the second knit layer 150. The greater knit density in the first knit layer 140 may be particularly advantageous when the first knit layer 140 is positioned exteriorly so that there is sufficient thermoplastic polymer material from the first knit layer 140 to extend to the inner-facing surface 162 adjacent to the second knit layer 150. However, it should be understood that the first knit layer 140 may have the greater knit density even where the first knit layer 140 is positioned interior to the second knit layer 150. The difference in knit density can be between about 10-50% in different aspects.

While not shown in FIGS. 13A-13D, the first knit layer 140 may include another yarn, e.g., a monofilament having a thermoplastic polymer material, e.g., like the yarn 146 in FIG. 5. In some aspects, the thermoplastic polymer material of this additional yarn can be melted during the heating process and become part of the thermoplastic polymer layer 160. In other aspects, the thermoplastic polymer material is not melted when heat is applied and may remain in the yarn post-heating (e.g., FIG. 13B).

Figure 14:
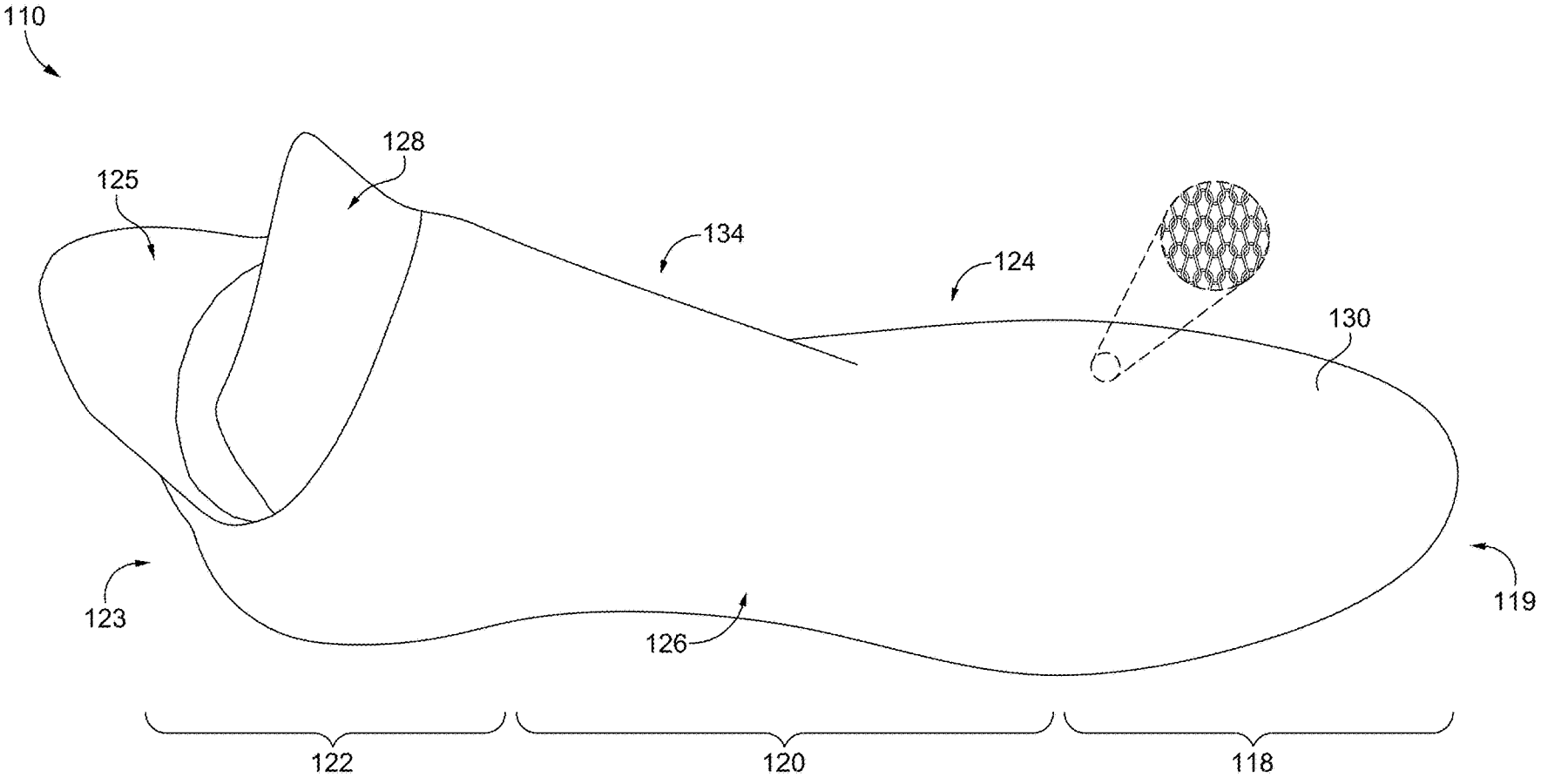
FIG. 14 depicts a medial side perspective view of the upper of FIGS. 1A-1B, in accordance with aspects herein.

FIG. 14 is a perspective view of the medial side of the upper 110 after the knitted component 130 has been heated, in accordance with aspects herein. In some aspects, the courses and wales of the knitted component 130 may change directions in different parts of the upper 110. In the forefoot region 118 at the toe end 119, the courses may run in a medial-lateral direction while the wales run in a toe-to-heel direction, but in the midfoot region 120, the courses and wales may run diagonally over the throat region 134. In the example in FIG. 14, the wales extend in a medial toe to lateral heel diagonal direction. This difference in course and wale orientation may be created after knitting, such as during the step 1208 in FIGS. 12A and 12B. While the folded knitted component 130 is on the last 1212, the knitted component 130 may be manipulated, such as by twisting, so that a portion of the knitted component 130 is angled and the courses and wales over the throat region 134 extend in diagonal directions. Once the melted thermoplastic polymer material is melted and cooled, the knitted component 130 may stay in this manipulated (e.g., twisted) arrangement.

Figure 15:
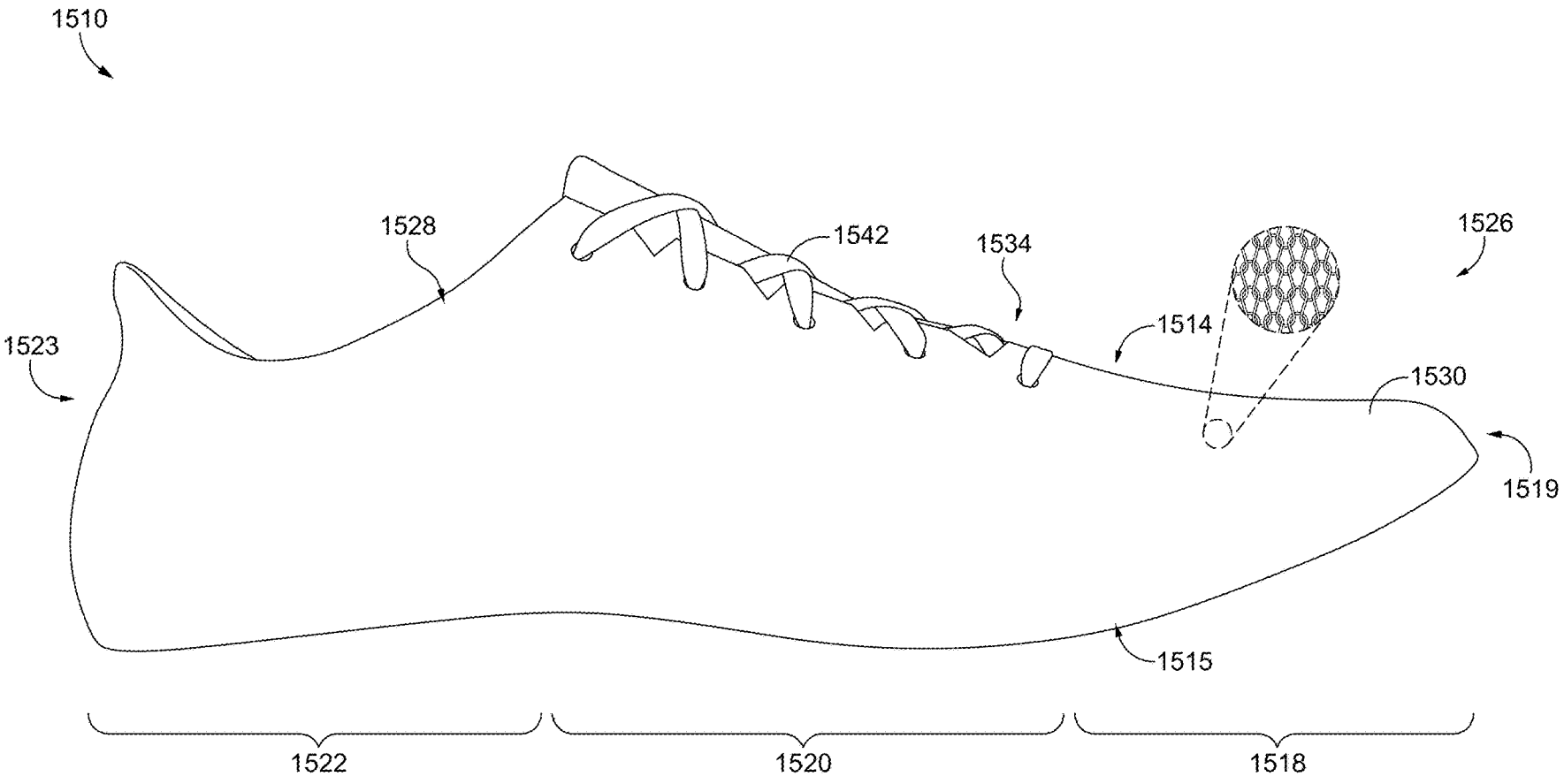
FIGS. 15 and 16 depict lateral and medial side views of an upper of an article of footwear, in accordance with aspects herein.
Figure 16:
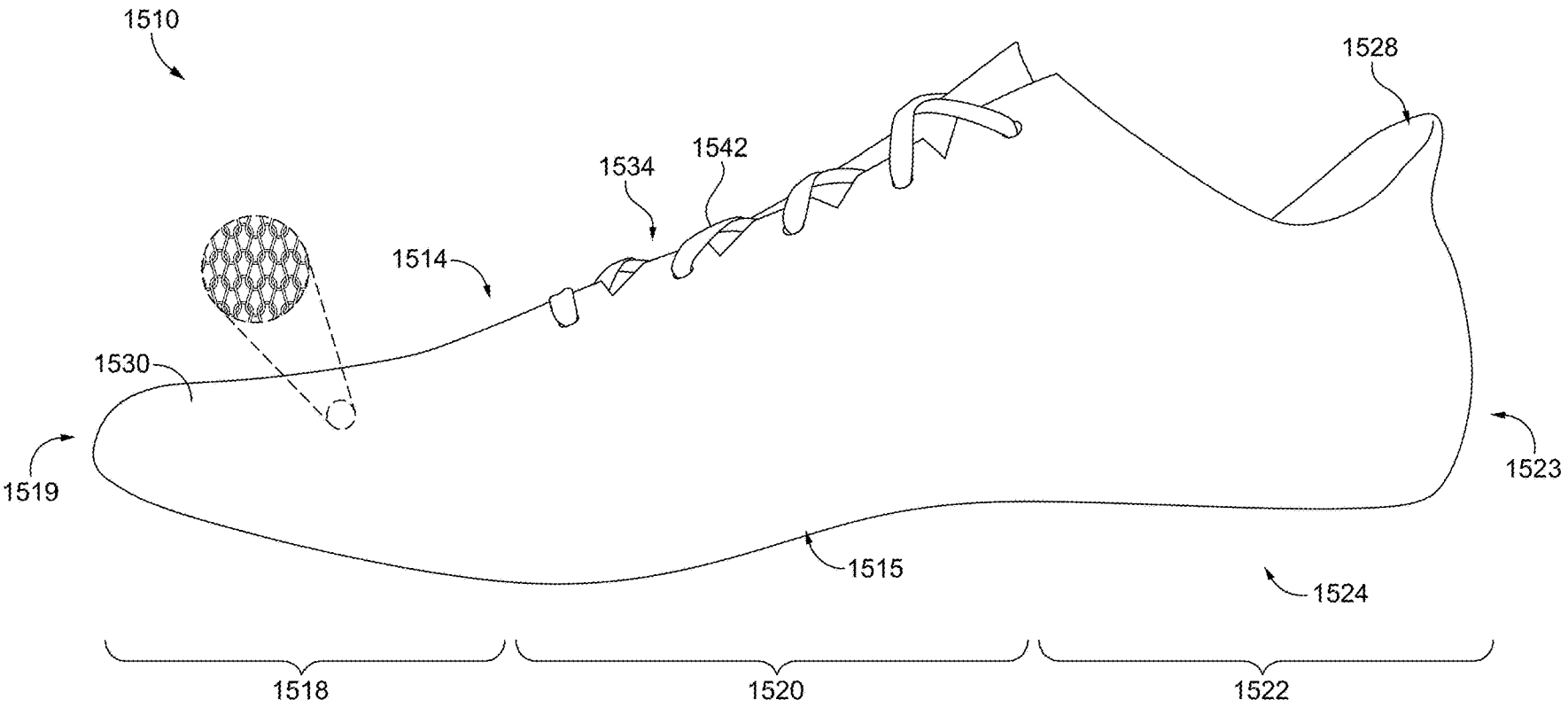

FIGS. 15 and 16 depict lateral and medial side views of another example upper 1510 formed with a knitted component 1530. In aspects, the knitted component 1530 can extend into, through, and/or across at least part or all of a forefoot region 1518 (e.g., having a toe end 1519), a midfoot region 1520, and/or a heel region 1522 (e.g., having a heel end 1523), and/or can extend into, through, and/or across at least part or all of a lateral side 1526 and/or a medial side 1524. In aspects, the knitted component 1530 can extend into, through, and/or across at least part or all of an overfoot portion 1514 of the upper 1510 and/or an underfoot portion 1515 of the upper 1510.

Figure 17:
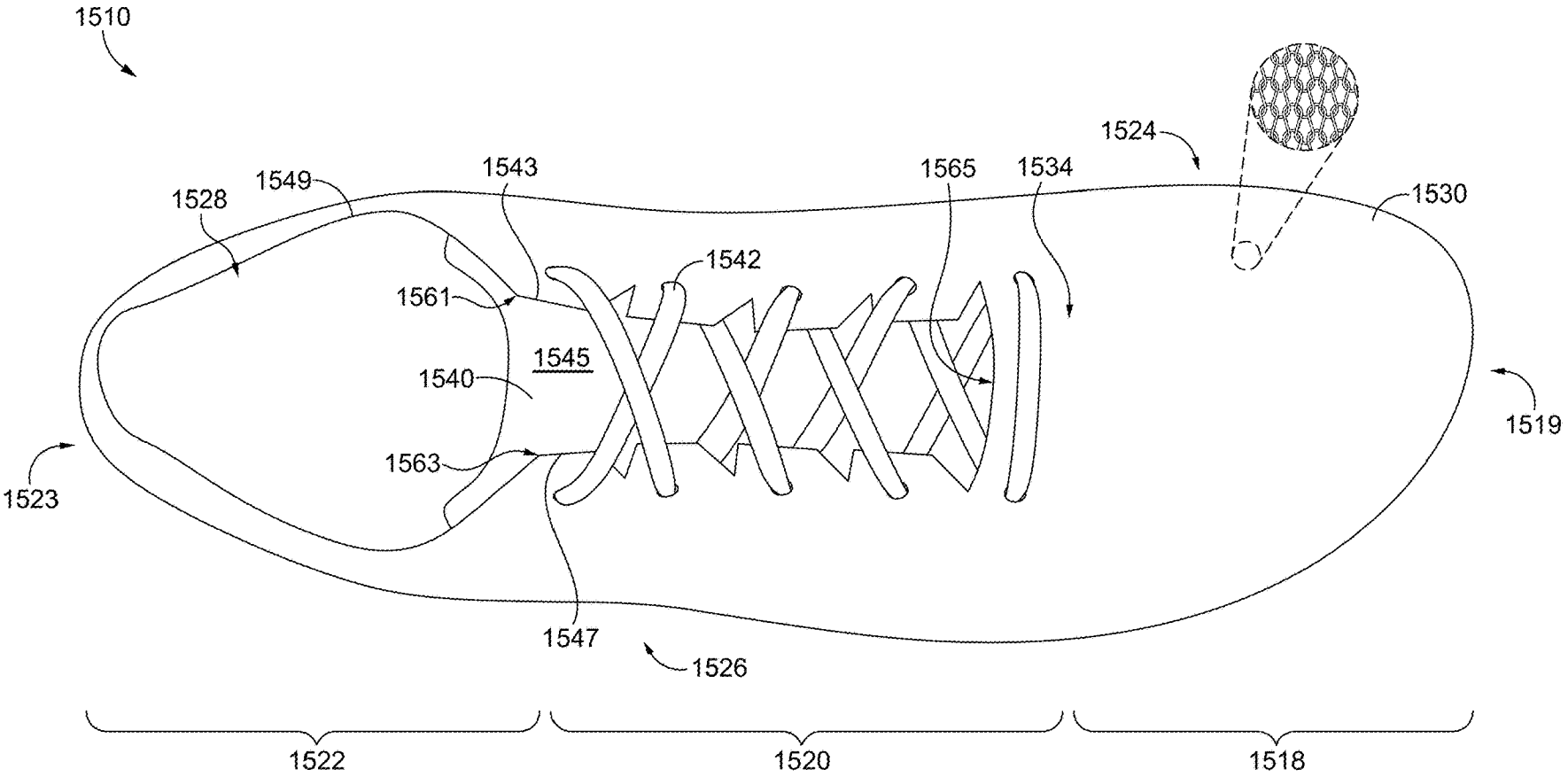
FIG. 17 depicts a top view of the upper of FIGS. 15 and 16, in accordance with aspects herein.

FIG. 17 depicts a top-down view of the upper 1510. The upper 1510 and the knitted component 1530 can have similar features previously described and illustrated with respect to the upper 110 and the knitted component 130 except in this example the upper 1510 may in some aspects have an at-least partially separable tongue 1540 with laces 1542. In some aspects, the tongue 1540 may be joined to the knitted component 130 at different locations, e.g., at least at the forward portion of the throat region 1534, e.g., via knitting or via a post-knitting process, such as sewing, bonding, or adhering. In aspects, the tongue 1540 may include one or multiple knit layers, e.g., in one aspect including a first knit layer, a second knit layer, and/or a thermoformed layer similar to other parts of the knitted component 1530. The tongue and upper may also be formed with a different unified or composite construction.

Looking still at FIG. 17, example processes for configuring a tongue of an upper will now be described, in accordance with aspects herein. To form a tongue, e.g., the tongue 1540, of an upper, e.g., the upper 1510, different methods can be used. For example, in some aspects, a knitted component, e.g., as in the knitted component 1530, can be formed with a substantially integral construction, e.g., a sock-like construction, and the knitted component can then be cut to at least partially or fully de-couple and/or separate a tongue, e.g., the tongue 1540, from the knitted component. For example, to form the tongue 1540 in FIG. 17, cuts can be made along a medial side 1543 and along a lateral side 1547 of a throat 1545 of the upper 1510, such that the knitted component 1530 and yarns thereof are discontinuous about a collar edge 1549 of the upper 1510, e.g., at locations 1561, 1563, but such that the tongue 1540 remains connected with the knitted component 1530 at a forward end 1565 of the throat 1545. In aspects, the tongue 1540 may be cut only along each of the medial and lateral sides 1543, 1547 of the throat 1545. In aspects, the tongue 1540 may also be cut and disconnected at the forward end 1565 of the throat 1545 such that the tongue 1540 is fully detached from the knitted component 1530. The tongue 1540, whether partially cut and detached or fully cut and detached, can be left for adjustment, or can be re-secured to the upper 1510 at least partially around the throat 1545, e.g., using stitching, bonding, adhesives, embroidery, or the like. In aspects, a tongue structure that is partially or fully cut from the upper may be modified to include lacing apertures, and/or lacing apertures can be formed in the throat portion from which the tongue is detached, e.g., as shown in FIG. 17. In aspects, a tongue structure that is partially or fully cut from an upper may be re-secured such that the upper overlaps at least part of the tongue, e.g., overlaps an outer perimeter area of the tongue, e.g., as shown in FIG. 17. In aspects, an upper may be cut to remove a tongue area, and a separately formed tongue, e.g., with similar or different properties than the upper, may be attached. For example, in some aspects, a separate tongue formed of a more elastic material with a higher degree of stretch can be attached to the upper in place of the cut-out tongue, e.g., to provide greater elasticity in the throat compared to other areas of the upper.

In addition, one distinction between the upper 1510 and the knitted component 1530 in FIGS. 15-17 and the upper 110 and the knitted component 130 of FIGS. 1A-4B is the collar. In FIGS. 15-17, the collar 1528 does not include a tongue tab, e.g., like the tongue tab 116 of the collar 128 in FIGS. 1A-4B, and the collar 1528 of the knitted component 1530 can have the same yarns and knit constructions as other parts of the upper. Thus, the collar 1528 may include a thermoplastic polymer layer, e.g., similar to thermoplastic polymer layer 160. In addition, the knitted component 130 may not include the third knit portion 924. The remaining features of the upper 110 and the knitted component 130 (including how they are incorporated into an article of footwear 100 with sole structures) may be applied to the upper 1510 and the knitted component 1530 without being repeated here.

Figure 18:
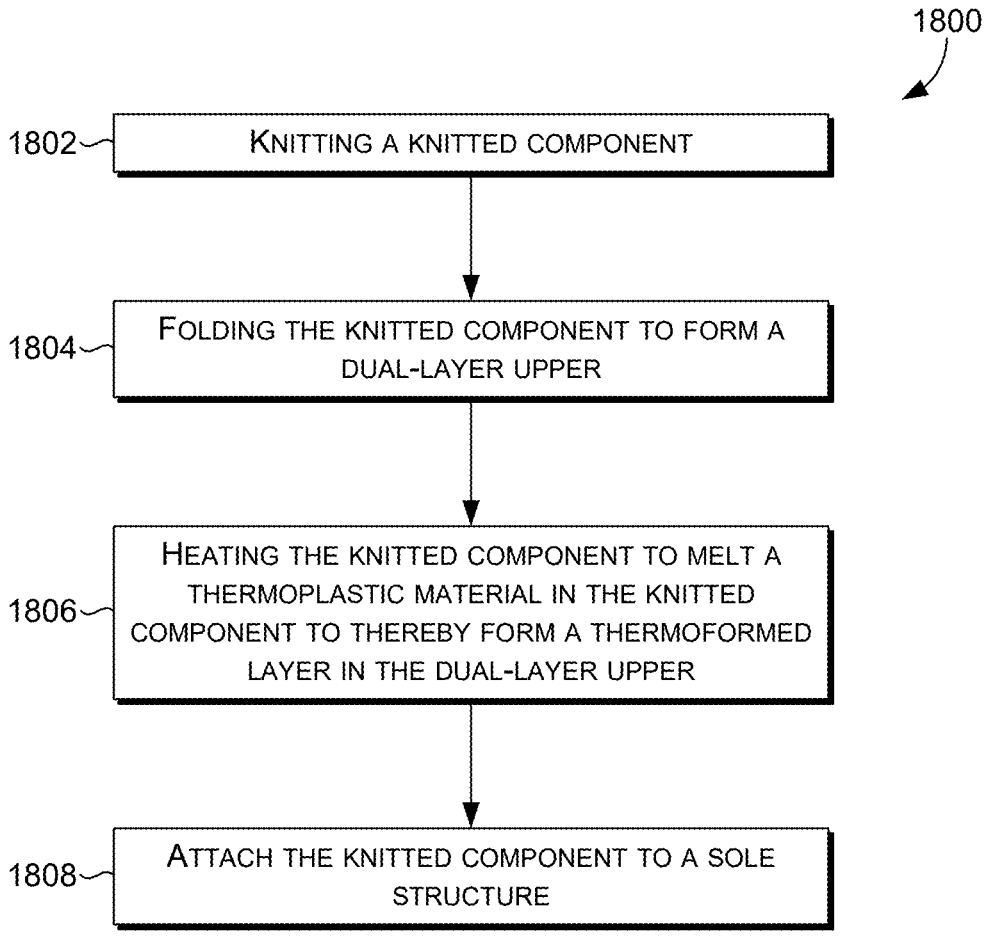
FIG. 18 depicts a block diagram of an example method of manufacturing an upper and/or an article of footwear according to aspects described herein.

Looking at FIG. 18, a block diagram of a method 1800 of manufacturing an upper and/or an article of footwear is provided, according to aspects of the present disclosure. In block 1802, the method 1800 includes knitting a knitted component, e.g., such as the knitted component 130 shown in FIGS. 1A-4B. The knitted component can be a single layer knitted component or a multi-layer knitted component, e.g., a dual-layer knitted component with a first knit layer and a second knit layer that are coextensive and overlapping. In block 1804, the method 1800 includes folding the knitted component onto itself to form a dual-layer upper, e.g., as shown in the process depicted in FIGS. 12A and 12B. In block 1806, the method 1800 includes heating the knitted component to melt a thermoplastic material in the knitted component to thereby form a thermoformed layer in the upper. In some examples, the thermoplastic material can originate as part of one or more yarns used to form part or all of the knitted component. The yarns can be entirely thermoplastic material or partially thermoplastic material (e.g., a core-sheath yarn with thermoplastic material forming a sheath surrounding a fiber or filament or multi-filament core with a higher melting or deformation temperature). In block 1808, the method 1800 further comprises attaching the upper to a sole structure. In some examples, the upper may be attached to the sole structure, e.g., midsole portion thereof, without a strobel, e.g., being connected through direct attachment, e.g., using adhesives, bonding, or another process.

Methods herein can further include providing an upper or article of footwear or multiple articles of footwear each comprising a sole structure secured to an upper according to any of the aspects described in this disclosure.

CLAUSES

Clause 1. An article of footwear, comprising: an upper, comprising: a knitted component, comprising: a first knit layer having a first knit density and comprising a first set of yarns; a second knit layer having a second knit density and comprising a second set of yarns having a greater diameter than the first set of yarns, the first knit layer and the second knit layer each defining at least part of an ankle opening of the upper and extending continuously around an overfoot portion and an underfoot portion of the upper; and a thermoplastic polymer layer bonding the first knit layer and the second knit layer and at least partially encapsulating courses of the first set of yarns and courses of the second set of yarns; and a sole structure secured to the upper.

Clause 2. The article of footwear of clause 1, wherein the first knit layer forms an inner-facing surface of the upper and the second knit layer forms an outer-facing surface of the upper.

Clause 3. The article of footwear of clause 1 or 2, wherein the inner-facing surface has a smoother texture than the outer-facing surface.

Clause 4. The article of footwear of any of clauses 1-3, wherein the first knit layer forms an outer-facing surface of the upper and the second knit layer forms an inner-facing surface of the upper.

Clause 5. The article of footwear of any of clauses 1-4, wherein the inner-facing surface has a smoother texture than the outer-facing surface.

Clause 6. The article of footwear of any of clauses 1-5, wherein the first knit layer and the second knit layer each extend continuously through a heel region, through a midfoot region, and through a forefoot region of the upper.

Clause 7. The article of footwear of any of clauses 1-6, wherein the upper is attached to the sole structure without a strobel.

Clause 8. The article of footwear of any of clauses 1-7, wherein the underfoot portion of the upper is directly secured to a midsole.

Clause 9. The article of footwear of any of clauses 1-8, wherein the thermoplastic polymer layer is absent from a collar region of the upper.

Clause 10. The article of footwear of any of clauses 1-9, wherein the collar region comprises a tongue tab extending from a throat region.

Clause 11. The article of footwear of any of clauses 1-10, wherein the collar region comprises a heel tab.

Clause 12. The article of footwear of any of clauses 1-11, wherein the thermoplastic polymer layer extends continuously around the overfoot portion of the upper and the underfoot portion of the upper.

Clause 13. The article of footwear of any of clauses 1-12, wherein the thermoplastic polymer layer extends throughout the upper except in a collar region.

Clause 14. The article of footwear of any of clauses 1-13, wherein the thermoplastic polymer layer extends continuously through a heel region, through a midfoot region, and through a forefoot region of the upper.

Clause 15. The article of footwear of any of clauses 1-14, wherein the second set of yarns has a tenacity that is at least 5 grams per denier (g/D).

Clause 16. The article of footwear of any of clauses 1-15, wherein the second set of yarns has a higher tenacity than the first set of yarns.

Clause 17. The article of footwear of any of clauses 1-16, wherein the first set of yarns is absent from a collar region of the upper.

Clause 18. The article of footwear of any of clauses 1-17, wherein the knitted component comprises a single seam, and wherein the single seam extends along the underfoot portion.

Clause 19. The article of footwear of any of clauses 1-18, wherein the single seam extends within a forefoot region from a toe end of the upper towards a heel region and terminates within the forefoot region.

Clause 20. The article of footwear of any of clauses 1-19, wherein courses of the first knit layer and courses of the second knit layer extend in a medial-lateral direction in a forefoot region of the upper and courses of the first knit layer and courses of the second knit layer extend diagonally across a throat region.

Clause 21. The article of footwear of any of clauses 1-20, wherein a plurality of adjacent wales in the first knit layer and a plurality of adjacent wales in the second knit layer extend continuously through a forefoot region and through a throat region, wherein each wale of the plurality of adjacent wales in the first knit layer and each wale of the plurality of adjacent wales in the second knit layer extends in a toe-heel direction in the forefoot region and extends diagonally to the toe-heel direction in the throat region.

Clause 22. The article of footwear of any of clauses 1-21, wherein the second knit density is greater than the first knit density.

Clause 23. The article of footwear of any of clauses 1-22, wherein the first knit density is greater than the second knit density.

Clause 24. The article of footwear of any of clauses 1-23, wherein knit wales of the first knit layer are offset from knit wales of the second knit layer.

Clause 25. The article of footwear of any of clauses 1-24, wherein the knitted component comprises a plurality of protrusions on an outer-facing surface of the upper.

Clause 26. The article of footwear of any of clauses 1-25, wherein each one of the plurality of protrusions comprises a portion of the first knit layer, a portion of the second knit layer, and a portion of the thermoplastic polymer layer.

Clause 27. A method of manufacturing a knitted component for an upper of an article of footwear, the method comprising: knitting a first knit layer with a first set of yarns, the first set of yarns comprising a first yarn component and a second yarn component comprising a thermoplastic polymer material that has a lower melting temperature than the first yarn component; knitting a second knit layer with a second set of yarns having a higher melting temperature than the second yarn component of the first set of yarns, the first set of yarns being absent from the second knit layer, wherein the first knit layer has a different knit density than the second knit layer; arranging the first knit layer and the second knit layer on a last so that each of the first knit layer and the second knit layer extends continuously around an overfoot portion and around an underfoot portion of the last and such that either the first knit layer or the second knit layer forms an exterior knit layer; and applying heat to the first knit layer and the second knit layer so that the thermoplastic polymer material melts to form a thermoplastic polymer layer that at least partially encapsulates courses of the first yarn component and the second set of yarns, wherein, after the thermoplastic polymer material has cooled, the thermoplastic polymer layer bonds together the first knit layer and the second knit layer.

Clause 28. The method of manufacturing of clause 27, wherein knitting the first knit layer and knitting the second knit layer comprises knitting a tubular knit structure having a first knit portion at a first end and a second knit portion at a second end, the first knit portion forming at least part of the first knit layer and the second knit portion forming at least part of the second knit layer.

Clause 29. The method of manufacturing of clause 27 or 28, wherein the first knit portion has a first diameter and the second knit portion has a second diameter that is different than the first diameter.

Clause 30. The method of manufacturing of any of clauses 27-29, wherein arranging the first knit layer and the second knit layer on the last comprises folding the tubular knit structure so that the first knit portion and the second knit portion are arranged in a layered configuration.

Clause 31. The method of manufacturing of any of clauses 27-30, wherein the tubular knit structure is knit on a flat knitting machine.

Clause 32. The method of manufacturing of any of clauses 27-31, wherein the tubular knit structure comprises a third knit portion located between the first knit portion and the second knit portion, the first set of yarns being absent from the third knit portion, wherein after the first knit layer and the second knit layer are arranged on the last, the third knit portion forms a collar region defining an ankle opening.

Clause 33. The method of manufacturing of any of clauses 27-32, wherein the tubular knit structure comprises an opening on at least one of the first end and the second end, wherein after the tubular knit structure is folded over onto itself on the last, a seam closes the opening and extends along the underfoot portion.

Clause 34. The method of manufacturing of any of clauses 27-33, wherein the first knit layer and the second knit layer are integrally knit together along an ankle opening of the upper.

Clause 35. The method of manufacturing of any of clauses 27-34, wherein the first knit layer is positioned on the last and then the second knit layer is arranged to be the exterior knit layer.

Clause 36. The method of manufacturing of any of clauses 27-35, wherein, after the first knit layer and the second knit layer have cooled, the first knit layer forms an inner-facing surface and the second knit layer forms an outer-facing surface, wherein the inner-facing surface is smoother than the outer-facing surface.

Clause 37. The method of manufacturing of any of clauses 27-36, wherein the second knit layer is positioned on the last and then the first knit layer is arranged to be the exterior knit layer.

Clause 38. The method of manufacturing of any of clauses 27-37, wherein, after the first knit layer and the second knit layer have cooled, the second knit layer forms an inner-facing surface and the first knit layer forms an outer-facing surface, wherein the inner-facing surface is smoother than the outer-facing surface.

Clause 39. The method of manufacturing of any of clauses 27-38, wherein the first knit layer and the second knit layer each have bootie constructions that extend continuously through a heel region, a midfoot region, and a forefoot region of the upper.

Clause 40. The method of manufacturing of any of clauses 27-39, further comprising removing the first knit layer and the second knit layer from the last to form the upper, and securing the upper to a midsole structure, wherein the midsole structure is secured directly to the exterior knit layer without a strobel.

Clause 41. The method of manufacturing of any of clauses 27-40, wherein the thermoplastic polymer layer is absent from a collar region of the upper after the heat is applied.

Clause 42. The method of manufacturing of any of clauses 27-41, wherein the collar region comprises a tongue tab and a heel tab.

Clause 43. The method of manufacturing of any of clauses 27-42, wherein the thermoplastic polymer layer bonds together the first knit layer and the second knit layer around the entire upper except in a collar region.

Clause 44. The method of manufacturing of any of clauses 27-43, wherein the first yarn component of the first set of yarns forms a core and the second yarn component forms a sheath surrounding the core.

Clause 45. The method of manufacturing of any of clauses 27-44, wherein the second set of yarns has a tenacity that is at least 5 grams per denier (g/D).

Clause 46. The method of manufacturing of any of clauses 27-45, wherein the second set of yarns has a higher tenacity than the first set of yarns.

Clause 47. The method of manufacturing of any of clauses 27-46, wherein, while the first knit layer and the second knit layer are arranged on the last, a portion of the first knit layer and the second knit layer are twisted so that at least a portion of knit wales of the knitted component are curved as they extend from a forefoot region to an ankle opening.

Clause 48. The method of manufacturing of any of clauses 27-47, wherein the heat is applied while the first knit layer and the second knit layer remain twisted.

Clause 49. The method of manufacturing of any of clauses 27-48, wherein the first knit layer has a lower knit density than the second knit layer.

Clause 50. The method of manufacturing of any of clauses 27-49, wherein the first knit layer has a higher knit density than the second knit layer.

Clause 51. The method of manufacturing of any of clauses 27-50, wherein, prior to applying the heat, a cover is positioned at least partially over the exterior knit layer, and wherein, upon applying the heat, the cover imparts a texture to at least the exterior knit layer.

Clause 52. The method of manufacturing of any of clauses 27-51, wherein the cover comprises positive protruding features such that the texture imparted to the exterior knit layer is a negative texture formed by the positive protruding features in the cover pressing into the exterior knit layer.

Clause 53. The method of manufacturing of any of clauses 27-52, wherein, when the first knit layer and the second knit layer are arranged on the last, knit wales of the first knit layer are offset from knit wales of the second knit layer.

Clause 54. The article of footwear of any of clauses 1-26, wherein the knitted component forms a tongue of the upper, wherein the tongue is integrally connected with the knitted component at a forward end of the tongue, and wherein the tongue is de-coupled such that the knitted component is discontinuous about a collar of the upper.

In some aspects, this disclosure may include the language, for example, "at least one of [element A] and [element B]." This language may refer to one or more of the elements. For example, "at least one of A and B" may refer to "A," "B," or "A and B." In other words, "at least one of A and B" may refer to "at least one of A and at least one of B," or "at least either of A or B." In some aspects, this disclosure may include the language, for example, "[element A], [element B], and/or [element C]." This language may refer to either of the elements or any combination thereof. In other words, "A, B, and/or C" may refer to "A," "B," "C," "A and B," "A and C," "B and C," or "A, B, and C." In addition, this disclosure may use the term "and/or" which may refer to any one or combination of the associated elements. In addition, this disclosure may use the term "a" (element) or "the" (element). This language may refer to the referenced element in the singular or in the plural and is not intended to be limiting in this respect.

This detailed description is provided in order to meet statutory requirements. However, this description is not intended to limit the scope of the invention described herein. Rather, the claimed subject matter may be embodied in different ways, to include different steps, different combinations of steps, different elements, and/or different combinations of elements, similar to those described in this disclosure, and in conjunction with other present or future technologies or solutions. Moreover, although the terms "step" or "block" may be used herein to identify different elements of methods employed, the terms should not be interpreted as implying any particular order among or between different elements except when the order is explicitly stated.

The subject matter of this disclosure has been described in relation to particular aspects, which are intended in all respects to be illustrative rather than restrictive. In this sense, alternative aspects will become apparent to those of ordinary skill in the art to which the present subject matter pertains without departing from the scope hereof. In addition, different combinations and sub-combinations of elements disclosed, as well as use and inclusion of elements not shown, are possible and contemplated as well.

What is claimed is:

1. An article of footwear, comprising:

an upper, comprising:

a knitted component, comprising:

a first knit layer having a first knit density and comprising a first set of yarns;

a second knit layer having a second knit density and comprising a second set of yarns having a greater diameter than the first set of yarns, the first knit layer and the second knit layer each defining at least part of an ankle opening of the upper and extending continuously around an overfoot portion and an underfoot portion of the upper; and a thermoplastic polymer layer bonding the first knit layer and the second knit layer and at least partially encapsulating courses of the first set of yarns and courses of the second set of yarns; and a sole structure secured to the upper.

2. The article of footwear of claim 1, wherein the first knit layer forms an inner-facing surface of the upper and the second knit layer forms an outer-facing surface of the upper.

3. The article of footwear of claim 2, wherein the inner-facing surface has a smoother texture than the outer-facing surface.

4. The article of footwear of claim 1, wherein the first knit layer forms an outer-facing surface of the upper and the second knit layer forms an inner-facing surface of the upper.

5. The article of footwear of claim 4, wherein the inner-facing surface has a smoother texture than the outer-facing surface.

6. The article of footwear of claim 1, wherein the first knit layer and the second knit layer each extend continuously through a heel region, through a midfoot region, and through a forefoot region of the upper.

7. The article of footwear of claim 1, wherein the upper is attached to the sole structure without a strobel.

8. The article of footwear of claim 1, wherein the underfoot portion of the upper is directly secured to a midsole.

9. The article of footwear of claim 1, wherein the thermoplastic polymer layer is absent from a collar region of the upper.

10. The article of footwear of claim 9, wherein the collar region comprises a tongue tab extending from a throat region.

11. The article of footwear of claim 9, wherein the collar region comprises a heel tab.

12. The article of footwear of claim 1, wherein the thermoplastic polymer layer extends continuously around the overfoot portion of the upper and the underfoot portion of the upper.

13. The article of footwear of claim 1, wherein the thermoplastic polymer layer extends throughout the upper except in a collar region.

14. The article of footwear of claim 1, wherein the thermoplastic polymer layer extends continuously through a heel region, through a midfoot region, and through a forefoot region of the upper.

15. The article of footwear of claim 1, wherein the second set of yarns has a tenacity that is at least 5 grams per denier (g/D).

16. The article of footwear of claim 1, wherein the second set of yarns has a higher tenacity than the first set of yarns.

17. The article of footwear of claim 1, wherein the first set of yarns is absent from a collar region of the upper.

18. The article of footwear of claim 1, wherein the knitted component comprises a single seam, and wherein the single seam extends along the underfoot portion.

19. The article of footwear of claim 18, wherein the single seam extends within a forefoot region from a toe end of the upper towards a heel region and terminates within the forefoot region.

20. The article of footwear of claim 1, wherein courses of the first knit layer and courses of the second knit layer extend in a medial-lateral direction in a forefoot region of the upper and courses of the first knit layer and courses of the second knit layer extend diagonally across a throat region.

21. The article of footwear of claim 1, wherein a plurality of adjacent wales in the first knit layer and a plurality of adjacent wales in the second knit layer extend continuously through a forefoot region and through a throat region, wherein each wale of the plurality of adjacent wales in the first knit layer and each wale of the plurality of adjacent wales in the second knit layer extends in a toe-heel direction in the forefoot region and extends diagonally to the toe-heel direction in the throat region.

22. The article of footwear of claim 1, wherein the second knit density is greater than the first knit density.

23. The article of footwear of claim 1, wherein the first knit density is greater than the second knit density.

24. The article of footwear of claim 1, wherein knit wales of the first knit layer are offset from knit wales of the second knit layer.

25. The article of footwear of claim 1, wherein the knitted component comprises a plurality of protrusions on an outer-facing surface of the upper.

26. The article of footwear of claim 25, wherein each one of the plurality of protrusions comprises a portion of the first knit layer, a portion of the second knit layer, and a portion of the thermoplastic polymer layer.

27. The article of footwear of claim 1, wherein the knitted component forms a tongue of the upper, wherein the tongue is integrally connected with the knitted component at a forward end of the tongue, and wherein the tongue is de-coupled such that the knitted component is discontinuous about a collar of the upper.

28. An article of footwear, comprising:

an upper, comprising:

a knitted component, comprising:

a first knit layer comprising a first knit density;

a second knit layer comprising a second knit density that is different from the first knit density, the first knit layer and the second knit layer folded at a collar of the upper and extending into an underfoot portion of the upper; and a fused material that secures the first knit layer and the second knit layer together by at least partially encapsulating courses of the first knit layer and courses of the second knit layer; and a sole structure secured to the upper.

29. The article of footwear of claim 28, wherein the first knit layer and the second knit layer are coextensive portions of the knitted component that are folded against each other and extend fully around an overfoot portion of the upper and the underfoot portion of the upper.

30. The article of footwear of claim 28, wherein the fused material is from a yarn of the knitted component that comprises a thermoplastic material.

31. The article of footwear of claim 30, wherein the yarn is integrated into the first knit layer.

32. The article of footwear of claim 30, wherein the yarn is integrated into the first knit layer and is absent from the second knit layer.

33. The article of footwear of claim 32, wherein the first knit layer is an inner knit layer of the upper.

34. The article of footwear of claim 30, wherein the yarn comprises a core-sheath yarn.

35. The article of footwear of claim 28, wherein courses of the first knit layer and courses of the second knit layer are oriented such as to extend in different directions on the upper.

36. The article of footwear of claim 28, wherein at least some courses of the knitted component are oriented to extend diagonal to a toe-to-heel direction of the upper.

37. The article of footwear of claim 28, wherein at least some wales of the knitted component are oriented to extend diagonal to a toe-to-heel direction of the upper.

38. The article of footwear of claim 28, wherein the knitted component comprises a plurality of protrusions located on an outer-facing surface of the upper.

39. The article of footwear of claim 38, wherein each one of the plurality of protrusions comprises a portion of the first knit layer, a portion of the second knit layer, and a portion of the fused material.

40. The article of footwear of claim 28, wherein the first knit layer and the second knit layer are coextensive at the collar, and wherein the first knit layer and the second knit layer are attached together at a seam that is spaced-apart from the collar.

41. The article of footwear of claim 40, wherein the seam extends on the underfoot portion of the upper.

42. The article of footwear of claim 41, wherein the seam further extends on an overfoot portion of the upper.

43. The article of footwear of claim 40, wherein the seam is located in a forefoot region of the upper.

* * * * *